US007850528B2

(12) United States Patent
Wells

(10) Patent No.: US 7,850,528 B2
(45) **Date of Patent: *Dec. 14, 2010**

(54) WIRELESS GAME PLAYER

(75) Inventor: William R. Wells, Reno, NV (US)

(73) Assignee: IGT, Reno, NV (US)

( * ) Notice: Subject to any disclaimer, the term of this patent is extended or adjusted under 35 U.S.C. 154(b) by 48 days.

This patent is subject to a terminal disclaimer.

(21) Appl. No.: 11/014,150

(22) Filed: Dec. 14, 2004

(65) Prior Publication Data

US 2005/0101383 A1 May 12, 2005

Related U.S. Application Data

(63) Continuation of application No. 09/967,326, filed on Sep. 28, 2001, now Pat. No. 6,846,238.

(51) Int. Cl.
*A63F 9/24* (2006.01)

(52) U.S. Cl. ..... 463/42; 463/25; 463/39

(58) Field of Classification Search ..... None
See application file for complete search history.

(56) References Cited

U.S. PATENT DOCUMENTS 4,335,809 A 6/1982 Wain
4,467,424 A * 8/1984 Hedges et al. ..... 463/26
4,614,342 A 9/1986 Takashima
4,624,462 A * 11/1986 Itkis ..... 273/237
4,764,666 A 8/1988 Bergeron
4,837,422 A * 6/1989 Dethloff et al. ..... 235/380
4,856,787 A 8/1989 Itkis
5,038,022 A 8/1991 Lucero
5,048,831 A 9/1991 Sides
5,054,787 A 10/1991 Richardson (Continued)

FOREIGN PATENT DOCUMENTS

AT 184721 T 10/1999

(Continued)

OTHER PUBLICATIONS

Laptop.pdf as copied from Wikipedia (en.wikipedia.org/wiki/laptop), 22 pages.*

(Continued)

*Primary Examiner*—M. Sager
(74) *Attorney, Agent, or Firm*—Weaver Austin Villeneuve & Sampson LLP

(57) ABSTRACT

A disclosed gaming machine provides methods and apparatus for operating a wireless game player that presents a game of chance executed on a gaming machine in communication with the wireless game player. In one embodiment, the wireless game player is a hand-held mobile device, electronically linked to a licensed gaming machine via a wireless connection. All random number generation (RNG) events, game outcomes, meter information, game related information, and all cash transactions are maintained in the licensed (controlled) gaming machine and not the wireless game player. The wireless game player may be used anywhere within the legal areas of the casino and it has the capability of identifying who is using it. For example, a biometric input device, such as a finger print reader may be used on the wireless game player to identify the player. Thus, the issue of under-age or excluded players is addressed.

37 Claims, 6 Drawing Sheets

U.S. PATENT DOCUMENTS

| | | | | | |
|---|---|---|---|---|---|
| 5,069,453 | A | * | 12/1991 | Koza et al. | 463/17 |
| 5,112,050 | A | * | 5/1992 | Koza et al. | 463/17 |
| 5,129,652 | A | | 7/1992 | Wilkinson | |
| 5,178,389 | A | | 1/1993 | Bentley et al. | |
| 5,218,356 | A | | 6/1993 | Knapp | |
| 5,242,163 | A | * | 9/1993 | Fulton | 463/13 |
| 5,265,874 | A | | 11/1993 | Dickinson et al. | |
| 5,324,035 | A | * | 6/1994 | Morris et al. | 463/42 |
| 5,342,047 | A | * | 8/1994 | Heidel et al. | 463/29 |
| 5,382,784 | A | | 1/1995 | Eberhardt | |
| 5,393,057 | A | * | 2/1995 | Marnell, II | 463/13 |
| 5,557,086 | A | | 9/1996 | Schulze et al. | |
| 5,618,045 | A | | 4/1997 | Kagan et al. | |
| 5,630,586 | A | * | 5/1997 | Lowden | 273/138.2 |
| 5,643,086 | A | | 7/1997 | Alcorn et al. | |
| 5,678,886 | A | | 10/1997 | Infanti | |
| 5,709,603 | A | | 1/1998 | Kaye | |
| 5,738,583 | A | | 4/1998 | Comas et al. | |
| 5,741,183 | A | | 4/1998 | Acres et al. | |
| 5,761,647 | A | | 6/1998 | Boushy | |
| 5,762,552 | A | | 6/1998 | Vuong et al. | |
| 5,768,382 | A | | 6/1998 | Schneier et al. | 380/23 |
| 5,770,533 | A | | 6/1998 | Franchi | |
| 5,779,545 | A | | 7/1998 | Berg et al. | |
| 5,779,546 | A | | 7/1998 | Meissner et al. | |
| 5,795,228 | A | | 8/1998 | Trumbull et al. | |
| 5,797,085 | A | | 8/1998 | Beuk et al. | |
| 5,810,664 | A | | 9/1998 | Clapper, Jr. | |
| 5,851,149 | A | | 12/1998 | Xidos et al. | |
| 5,871,398 | A | | 2/1999 | Schneier et al. | 463/16 |
| 5,905,523 | A | * | 5/1999 | Woodfield et al. | 725/99 |
| 5,915,023 | A | | 6/1999 | Bernstein | |
| 5,951,397 | A | * | 9/1999 | Dickinson | 463/36 |
| 5,970,143 | A | | 10/1999 | Schneier et al. | |
| 5,999,808 | A | | 12/1999 | LaDue | |
| 6,001,016 | A | | 12/1999 | Walker et al. | |
| 6,012,832 | A | | 1/2000 | Saunders et al. | |
| 6,012,983 | A | | 1/2000 | Walker et al. | 463/20 |
| 6,019,283 | A | | 2/2000 | Lucero | |
| 6,024,640 | A | | 2/2000 | Walker et al. | |
| 6,048,269 | A | | 4/2000 | Burns et al. | |
| 6,093,100 | A | | 7/2000 | Singer et al. | |
| 6,099,408 | A | | 8/2000 | Schneier et al. | |
| 6,104,815 | A | | 8/2000 | Alcorn et al. | |
| 6,105,008 | A | | 8/2000 | Davis et al. | |
| 6,106,396 | A | | 8/2000 | Alcorn et al. | |
| 6,110,041 | A | | 8/2000 | Walker et al. | |
| 6,113,495 | A | * | 9/2000 | Walker et al. | 463/42 |
| 6,117,013 | A | | 9/2000 | Eiba | |
| 6,135,887 | A | | 10/2000 | Pease et al. | |
| 6,149,522 | A | | 11/2000 | Alcorn et al. | |
| 6,178,510 | B1 | * | 1/2001 | O'Connor et al. | 726/5 |
| 6,234,896 | B1 | | 5/2001 | Walker et al. | |
| 6,264,559 | B1 | * | 7/2001 | Lawrence et al. | 463/40 |
| 6,264,561 | B1 | | 7/2001 | Saffari et al. | |
| 6,270,410 | B1 | | 8/2001 | DeMar et al. | |
| 6,280,326 | B1 | | 8/2001 | Saunders | |
| 6,285,868 | B1 | | 9/2001 | LaDue | 455/410 |
| 6,308,887 | B1 | | 10/2001 | Korman et al. | |
| 6,319,122 | B1 | * | 11/2001 | Packes et al. | 463/16 |
| 6,340,331 | B1 | | 1/2002 | Saunders et al. | |
| 6,354,941 | B2 | | 3/2002 | Miller et al. | |
| 6,394,907 | B1 | | 5/2002 | Rowe | |
| 6,402,614 | B1 | | 6/2002 | Schneier et al. | |
| 6,409,602 | B1 | * | 6/2002 | Wiltshire et al. | 463/42 |
| 6,416,414 | B1 | | 7/2002 | Stadelmann | |
| 6,424,819 | B1 | | 7/2002 | Yan | |
| 6,488,585 | B1 | | 12/2002 | Wells et al. | |
| 6,508,709 | B1 | * | 1/2003 | Karmarkar | 463/42 |
| 6,527,638 | B1 | | 3/2003 | Walker et al. | |
| 6,554,707 | B1 | | 4/2003 | Sinclair et al. | |
| 6,612,928 | B1 | * | 9/2003 | Bradford et al. | 463/29 |
| 6,628,939 | B2 | | 9/2003 | Paulsen | |
| 6,638,170 | B1 | | 10/2003 | Crumby | |
| 6,645,077 | B2 | | 11/2003 | Rowe | |
| 6,676,522 | B2 | | 1/2004 | Rowe et al. | |
| 6,682,421 | B1 | | 1/2004 | Rowe et al. | |
| 6,685,567 | B2 | | 2/2004 | Cockerille et al. | |
| 6,761,636 | B2 | * | 7/2004 | Chung et al. | 463/42 |
| 6,790,141 | B2 | | 9/2004 | Muir | |
| 6,800,029 | B2 | | 10/2004 | Rowe et al. | |
| 6,804,763 | B1 | | 10/2004 | Stockdale et al. | |
| 6,837,789 | B2 | | 1/2005 | Garahi et al. | |
| 6,843,725 | B2 | | 1/2005 | Nelson | |
| 6,846,238 | B2 | * | 1/2005 | Wells | 463/39 |
| 6,863,608 | B1 | | 3/2005 | LeMay et al. | |
| 6,918,831 | B2 | | 7/2005 | Nguyen et al. | |
| 6,942,570 | B2 | | 9/2005 | Schneier et al. | |
| 6,964,611 | B2 | | 11/2005 | Packes, Jr. et al. | |
| 6,971,956 | B2 | | 12/2005 | Rowe et al. | |
| 6,988,946 | B2 | | 1/2006 | Michaelson et al. | |
| 7,008,317 | B2 | | 3/2006 | Cote et al. | |
| 7,037,193 | B1 | | 5/2006 | Kasparov et al. | |
| 7,111,141 | B2 | | 9/2006 | Nelson | |
| 7,116,782 | B2 | | 10/2006 | Jackson et al. | |
| 7,384,339 | B2 | | 6/2008 | LeMay et al. | |
| 7,515,718 | B2 | | 4/2009 | Nguyen et al. | |
| 2001/0003100 | A1 | | 6/2001 | Yacenda | |
| 2001/0039204 | A1 | | 11/2001 | Tanskanen | |
| 2001/0041612 | A1 | | 11/2001 | Garahi et al. | |
| 2002/0035538 | A1 | | 3/2002 | Moreau | |
| 2002/0035605 | A1 | | 3/2002 | McDowell et al. | |
| 2002/0042729 | A1 | | 4/2002 | Yajima et al. | |
| 2002/0060243 | A1 | | 5/2002 | Janiak et al. | |
| 2002/0066041 | A1 | | 5/2002 | Lemke | |
| 2002/0068629 | A1 | | 6/2002 | Allen et al. | |
| 2002/0069166 | A1 | | 6/2002 | Moreau et al. | |
| 2002/0085515 | A1 | | 7/2002 | Jaynes et al. | |
| 2002/0089410 | A1 | | 7/2002 | Janiak et al. | |
| 2002/0094860 | A1 | | 7/2002 | Itkis et al. | |
| 2002/0098883 | A1 | | 7/2002 | Packes et al. | |
| 2002/0098888 | A1 | | 7/2002 | Rowe et al. | |
| 2002/0103008 | A1 | | 8/2002 | Rahn et al. | |
| 2002/0111213 | A1 | | 8/2002 | McEntee et al. | |
| 2002/0115487 | A1 | | 8/2002 | Wells | |
| 2002/0119800 | A1 | | 8/2002 | Jaggers et al. | |
| 2002/0193099 | A1 | | 12/2002 | Paulsen | |
| 2003/0031321 | A1 | | 2/2003 | Mages | |
| 2003/0040354 | A1 | | 2/2003 | Itkis et al. | |
| 2003/0045341 | A1 | | 3/2003 | Itkis et al. | |
| 2003/0064805 | A1 | | 4/2003 | Wells | |
| 2003/0104865 | A1 | | 6/2003 | Itkis et al. | |
| 2003/0130029 | A1 | | 7/2003 | Crumby | |
| 2003/0130039 | A1 | | 7/2003 | Nelson | |
| 2003/0159044 | A1 | | 8/2003 | Doyle et al. | |
| 2003/0171986 | A1 | | 9/2003 | Itkis et al. | |
| 2003/0232647 | A1 | | 12/2003 | Moser | |
| 2004/0002885 | A1 | | 1/2004 | Levy | |
| 2004/0038723 | A1 | | 2/2004 | Schneier et al. | |
| 2004/0048667 | A1 | | 3/2004 | Rowe | |
| 2004/0053674 | A1 | | 3/2004 | Nguyen et al. | |
| 2004/0053692 | A1 | | 3/2004 | Chatigny et al. | |
| 2004/0137987 | A1 | | 7/2004 | Nguyen et al. | |
| 2004/0192439 | A1 | | 9/2004 | Kula | |
| 2004/0209690 | A1 | | 10/2004 | Bruzzese et al. | |
| 2004/0224741 | A1 | | 11/2004 | Jen et al. | |
| 2004/0235550 | A1 | | 11/2004 | McNally et al. | |
| 2004/0242321 | A1 | | 12/2004 | Overton | |
| 2005/0009600 | A1 | | 1/2005 | Rowe et al. | |
| 2005/0059485 | A1 | | 3/2005 | Paulsen et al. | |
| 2005/0107164 | A1 | | 5/2005 | Muir et al. | |
| 2005/0130728 | A1 | | 6/2005 | Nguyen et al. | |
| 2005/0143169 | A1 | | 6/2005 | Nguyen et al. | |
| 2005/0164783 | A1 | | 7/2005 | Paulsen et al. | |

| | | | |
|---|---|---|---|
| 2005/0181870 | A1 | 8/2005 | Nguyen et al. |
| 2005/0239530 | A1 | 10/2005 | Walker et al. |
| 2006/0009275 | A1 | 1/2006 | Packes et al. |
| 2006/0019745 | A1 | 1/2006 | Benbrahim |
| 2006/0035707 | A1 | 2/2006 | Nguyen et al. |
| 2006/0058102 | A1 | 3/2006 | Nguyen et al. |
| 2006/0068895 | A1 | 3/2006 | Nguyen et al. |
| 2006/0111168 | A1 | 5/2006 | Nguyen et al. |
| 2007/0207852 | A1 | 9/2007 | Nelson et al. |
| 2008/0026844 | A1 | 1/2008 | Wells |
| 2008/0076547 | A1 | 3/2008 | Bigelow et al. |
| 2008/0076572 | A1 | 3/2008 | Nguyen et al. |
| 2008/0182667 | A1 | 7/2008 | Davis et al. |
| 2008/0188308 | A1 | 8/2008 | Shepherd et al. |

FOREIGN PATENT DOCUMENTS

| | | | |
|---|---|---|---|
| AU | 4664296 | A | 8/1996 |
| AU | 199871427 | | 4/1998 |
| AU | 199954012 | | 4/2000 |
| AU | 2001249901 | | 10/2001 |
| AU | 2001255746 | | 11/2001 |
| BR | 9606847 | A | 11/1997 |
| CA | 2 211 297 | A1 | 8/1996 |
| CA | 2 273 458 | | 1/2000 |
| CA | 2 302 548 | A1 | 5/2000 |
| CA | 2 211 297 | C | 8/2002 |
| CN | 1174620 | A | 2/1998 |
| CN | 1098510 | C | 1/2003 |
| CZ | 9702296 | A3 | 12/1997 |
| CZ | 294 347 | B6 | 12/2004 |
| DE | 195 02 613 | | 1/1995 |
| DE | 195 02 613 | A1 | 1/1996 |
| DE | 199 22 862 | A1 | 5/1999 |
| EP | 0 024 184 | A2 | 2/1981 |
| EP | 024184 | | 1/1984 |
| EP | 0649102 | A2 * | 10/1994 |
| EP | 0 631 247 | A2 | 12/1994 |
| EP | 0 744 786 | A1 | 11/1996 |
| EP | 0 806 024 | A1 | 11/1997 |
| EP | 0 924 657 | A2 | 6/1999 |
| EP | 0 806 024 | B1 | 9/1999 |
| EP | 1028551 | | 8/2000 |
| EP | 1045346 | A2 | 10/2000 |
| EP | 1 059 742 | A1 | 12/2000 |
| EP | 1 059 742 | A4 | 5/2001 |
| EP | 1 231 577 | | 8/2002 |
| FI | 973046 | A | 9/1997 |
| GB | 2 151 054 | A | 7/1985 |
| GB | 2 161 629 | | 1/1986 |
| GB | 2161008 | * | 1/1986 |
| GB | 2 284 913 | A | 6/1995 |
| HU | 9800695 (A2) | | 7/1998 |
| JP | 10512984 (T) | | 12/1998 |
| JP | 2002-530006 | T | 9/2002 |
| NO | 973355 | A | 9/1997 |
| NO | 316247 | B | 12/2003 |
| NO | 316247 | B1 | 12/2003 |
| PL | 321544 (A1) | | 12/1997 |
| RU | 2132569 | C1 | 6/1999 |
| RU | 2144264 | C1 | 1/2000 |
| RU | 2145116 | | 1/2000 |
| RU | 2174258 | C2 | 9/2001 |
| SK | 101397 | A3 | 2/1998 |
| SK | 284750 | B | 11/2005 |
| SK | 284750 | B6 | 11/2005 |
| WO | WO 93/10508 | | 5/1993 |
| WO | WO95/24689 | | 9/1995 |
| WO | WO96/00950 | | 1/1996 |
| WO | WO96/23289 | A1 | 8/1996 |
| WO | WO/9623289 | A1 | 8/1996 |
| WO | WO98/58509 | | 12/1998 |
| WO | WO99/23594 | | 5/1999 |
| WO | WO 99/34599 | | 7/1999 |
| WO | WO99/42964 | | 8/1999 |
| WO | WO99/51313 | | 10/1999 |
| WO | WO 0031982 | | 2/2000 |
| WO | WO/0028680 | A1 | 5/2000 |
| WO | WO-A-00/41428 | | 7/2000 |
| WO | WO-A-00/49731 | | 8/2000 |
| WO | WO00/67213 | | 11/2000 |
| WO | WO00/79467 | | 12/2000 |
| WO | 01/03786 | | 1/2001 |
| WO | WO01/00291 | A1 | 1/2001 |
| WO | WO01/01379 | A1 | 1/2001 |
| WO | WO/01/48712 | | 7/2001 |
| WO | WO01/54091 | | 7/2001 |
| WO | WO 0148712 | | 7/2001 |
| WO | WO01/74461 | | 10/2001 |
| WO | WO01/76710 | A2 | 10/2001 |
| WO | WO02/055163 | | 7/2002 |
| WO | WO 02/101486 | | 12/2002 |
| WO | WO02/102483 | A1 | 12/2002 |
| WO | WO02/103550 | | 12/2002 |
| WO | WO03/005743 | | 1/2003 |
| WO | WO03/008057 | A1 | 1/2003 |
| WO | WO03/019486 | | 3/2003 |
| WO | WO03/027970 | | 4/2003 |
| WO | WO2005/031666 | A1 | 4/2005 |
| WO | WO2006/009791 | | 1/2006 |
| WO | WO2006/138064 | | 12/2006 |
| WO | WO 08/030928 | | 3/2008 |

OTHER PUBLICATIONS

Wireless lan.pdf as copiedfrom Wikipedia (en.wikipedia.org/wiki/wireless_lan, 12 pages.*

Wireless network.pdf as copied from Wikipedia (en.wikipedia.org/wiki/wireless_network), 5 pages.*

PCI Local Bus.pdf as redirected from Mini PCI from search on Wikipedia (en.wikipedia.org/wiki/Mini_PCI), 15 pages.*

Wireless Router.pdf as copied from Wikipedia (en.wikipedia.org/wiki/wireless_router), 3 pages.*

The definition of graphical, The American Heritage Dictionary of the English Language, Third Edition, copyright 1992 by Houghton Mifflin Company.

Gigaset CL4 SIMpad description retrieved from http://web.archive.org/web/20010625204821/www.my-siemens.com/MySiemens/CDA/Standard/Frameset/0,1649,3_SIMPADCL4_0_0_61_0,FF.html (3 pages).

European Office Action dated Nov. 18, 2005 from Corresponding EP Application No. 02782084.4 (9 pages).

The definition of graphical, The American Heritage Dictionary of the English Language, Third Edition, copyright 1992 by Houghton Mifflin Company.

Notice of Allowance for U.S. Appl. No. 09/967,326, dated Sep. 20, 2004.

Office Action for Australia Patent Application No. 2002348579, dated Aug. 30, 2007.

"Internet/Intranet Information Appliance: Brilliant 15" Screen in Compact, Space saving Design," DT Research, Inc., www.dtresearch.com Oct. 2000, 2 pages.

European Search Report, dated Jan. 30, 2008, Application No. EP 07 01 5979.

Australian Office Action for Application No. 2002348579, dated Sep. 22, 2008.

Office Action for Russian Application No. 2004/109515/09, dated Sep. 12, 2006, (English translation provided).

Office Action for Russian Application No. 2004/109515/09, dated Feb. 8, 2007, (English translation provided).

Office Action for European Patent Application No. 02 782 084.4, dated Nov. 24, 2006.

Office Action for European Patent Application No. 02 782 084.4, dated Mar. 22, 2007.

Siemens Mobile Webpage, Jun. 8, 2001, http://de.wikipedia.org/wiki/SIMpad, downloaded on Apr. 16, 2007.

Communication from Russian Associate identifying "analogs" of patents cited in a Russian Advisory Action dated Sep. 12, 2006.
Office Action for European Patent Application No. 07005397.0, dated Jun. 15, 2007.
Anonymous: "EM5007W Multimedia Cassiopeia-Yellow", Casio.com, [Online], Aug. 2, 2001, XP002430868, Retrieved from the Internet: URL:http://web.archive.org/web/2001080165446/www.casio.com/personalpcs/product.cfm?section=19&product=1972> [retrieved on Apr. 24, 2007].
Anonymous: "E-125 Cassiopeia", Casio.com, [Online] XP002430869, Retrieved from the Internet: url:http://web.archive.org/web/20011004012420/www.casio.com/personalpcs/product.cfm?section=19&product=3553.
US Office Action dated Apr. 3, 2003 issued in U.S. Appl. No. 09/967,326.
US Office Action Final dated Oct. 20, 2003 issued in U.S. Appl. No. 09/967,326.
US Office Action (Advisory Action) dated Feb 2, 2004 issued in U.S. Appl. No. 09/967,326.
US Office Action dated Feb. 25, 2004 issued in U.S. Appl. No. 09/967,326.
US Office Action Final dated Dec. 15, 2008 issued in U.S. Appl. No. 11/888,326.
US Office Action (Notice of Abandonment dated) Jun. 10, 2009 issued in U.S. Appl. No. 11/888,326.
US Office Action dated Jun. 27, 2008 issued in U.S. Appl. No. 10/871,876.
US Office Action Final dated Feb. 12, 2009 issued in U.S. Appl. No. 10/871,876.
US Office Action (Advisory Action) dated Apr. 27, 2009 issued in U.S. Appl. No. 10/871,876.
US Office Action dated Jul. 29, 2009 issued in U.S. Appl. No. 10/871,876.
US Office Action Final dated Jul. 31, 2002 issued in U.S. Appl. No. 09/882,558.
US Office Action Final dated Feb. 21, 2003 issued in U.S. Appl. No. 09/882,558.
US Notice of Allowance dated May 9, 2003 issued in U.S. Appl. No. 09/882,558.
US Office Action dated Feb. 15, 2006 issued in U.S. Appl. No. 10/672,307.
US Office Action (Examiner Interview Summary) dated Jun. 20, 2006 issued in U.S. Appl. No. 10/672,307.
US Office Action dated Sep. 21, 2006 issued in U.S. Appl. No. 10/672,307.
US Office Action dated May 8, 2007 issued in U.S. Appl. No. 10/672,307.
US Office Action Final dated Oct. 11, 2007 issued in U.S. Appl. No. 10/672,307.
US Office Action dated May 1, 2008 issued in U.S. Appl. No. 10/672,307.
US Office Action (Examiner Interview Summary) dated Nov. 19, 2008 issued in U.S. Appl. No. 10/672,307.
US Office Action (Examiner Interview Summary) dated Feb. 27, 2009 issued in U.S. Appl. No. 10/672,307.
US Notice of Allowance dated Jul. 6, 2009 issued in U.S. Appl. No. 10/672,307.
US Office Action dated Oct. 9, 2009 issued in U.S. Appl. No. 11/155,702.
PCT International Search Report dated Sep. 23, 2003 issued in PCT/US02/31061.
PCT International Written Opinion dated Nov. 10, 2003 issued in PCT/US02/31061.
PCT International Preliminary Examination Report dated Jan. 19, 2004 issued in PCT/US02/31061.
AU Examiner's Report No. 3 dated Dec. 18, 2008 issued in AU Application No. 2002348579.
AU Examiner's Report No. 4 dated Mar. 30, 2009 issued in AU Application No. 2002348579.
EP Examination Report dated Aug. 3, 2004 issued in EP Application No. 02 782 084.4.
EP Result of Consultation dated Jul. 5, 2007 issued in EP Application No. 02 782 084.4.
EP Extended Search Report dated Jun. 6, 2007 issued in EP Application No. 07 005 397.0.
EP Summons to Attend Oral Proceedings dated Apr. 14, 2008 issued in EP 07 005 397.0/2221.
EP Examination dated Nov. 7, 2007 issued in EP Application No. 07 005 397.0-2221.
EP Result of Consultation dated Jan. 28, 2009 issued in EP Application No. 07 005 397.0-2221.
EP Decision to Refuse a European patent application dated Mar. 3, 2009 issued in EP Application No. 07 005 397.0-2221.
EP Communication re Examination dated Jun. 6, 2008 issued in EP 07 015 979.3-2221.
EP Summons to Attend Oral Proceedings dated Apr. 30, 2009 issued in EP 07 015 979.3-2221.
RU Office Action dated Sep. 12, 2006 issued in RU Application No. 2004/109515/09 (010378) (including list of references therein as provided by Russian Associate).
RU Office Action dated Feb. 8, 2007 issued in RU Application No. 2004/109515/09.
PCT International Search Report dated Sep. 19, 2005 issued in PCT/US2005/021350.
PCT International Preliminary Report on Patentability and Written Opinion dated Sep. 18, 2005 issued in PCT/US2005/021350.
PCT International Preliminary Examination Report dated Sep. 11, 2003 issued in PCT/US2002/18861.
PCT International Search Report dated Oct. 29, 2002 issued in PCT/US02/188861.
PCT Written Opinion dated Apr. 8, 2003 issued in PCT/US02/18661.
AU Examiner's First Report dated Mar. 9, 2006 issued in AU Application No. 2002347362.
CA Office Action dated Jun. 4, 2007 issued in CA Application No. 2,454,581.
CA Office Action dated Sep. 5, 2008 issued in CA Application No. 2,454,581.
CA Office Action dated Sep. 3, 2009 issued in CA Application No. 2,454,581.
EP Supplementary Search Report dated Dec. 4, 2008 issued in EP 02 752 049.3-2221.
RU Advisory Office Action dated May 26, 2006 issued in RU Application No. 2003136277/09 (039251).
RU Advisory Office Action dated Sep. 19, 2006 issued in RU Application No. 2003136277/09 (039251).
RU Grant of Patent dated Apr. 9, 2007 issued in RU Application No. 2003136277/09 (039251).
PCT International Search Report dated Jan. 19, 2005 issued in PCT/US2004/031315.
PCT International Preliminary Report on Patentability and Written Opinion dated Jan. 17, 2005 issued in PCT/US2004/031315.
CN Office Action dated May 16, 2008 issued in 2004800276444.
CN Office Action dated Apr. 24, 2009 issued in 2004800276444.
EP Examination Report dated Jul. 20, 2006 issued in EP Application No. 04 788 976.1-1238.
EP Summons to Attend Oral Proceedings dated Jan. 30, 2009 issued in EP 04 788 976.1.
PCT International Search Report dated Sep. 29, 2006 issued in PCT/US2006/021230 (WO 2006/138064).
PCT International Preliminary Examination Report and Written Opinion dated Sep. 29, 2006 issued in PCT/US2006/021230 (WO 2006/138064).
EP Examination Report dated May 4, 2009 issued in EP 06 760 619.4-1238.
Patent Abstracts of Japan vol. 2000, No. 22, Mar. 9, 2001 & JP 2001 146058 A (Sato Corp), May 29, 2001 abstract.
Palm™ m100 Specifications, www.palm.com [Retrieved from Internet on Sep. 6, 2006], 7 pages.
"Mobile Gaming System Policies", State of Nevada wireless gaming regulations, http://gaming.nv.gov/documents/pdf/techpolicy_06may18.pdf, [Retrieved from Internet on Sep. 6, 2006], 5 pages.
US Office Action Final dated Jan. 20, 2010 issued in U.S. Appl. No. 10/871,876.

US Office Action (Miscellaneous Communication to Applicant-No Action Count) dated Jan. 5, 2010 issued in U.S. Appl. No. 10/672,307.
US Notice of Allowance dated Jan. 22, 2010 issued in U.S. Appl. No. 10/672,307.
U.S. Office Action dated Aug. 22, 2002 issued in U.S. Appl. No. 09/882,559.
U.S. Office Action Final dated Jan. 27, 2003 issued in U.S. Appl. No. 09/882,559.
U.S. Notice of Allowance dated Jul. 16, 2003 issued in U.S. Appl. No. 09/882,559.
EP Commencement of Proceedings before the Board of Appeal dated Jul. 30, 2009 issued in EP Application No. 07 005 397.0-2221.
AU Examiner's First Report dated Sep. 7, 2009 issued in AU Application No. 2004277242.
CN Third Office Action dated Oct. 16, 2009 issued in 2004800276444.
EP Search Report dated Nov. 18, 2009 issued in EP 09 15 9225.3 (EP 2 083 402 A3).
CN First Office Action dated Oct. 16, 2009 issued in 200680021769.5.
PCT International Preliminary Examination Report dated Aug. 22, 2003 issued in PCT/US02/18875 (WO02/103550).
PCT International Search Report dated Sep. 12, 2002 issued in PCT/US02/18875 (WO02/103550).
PCT Written Opinion dated Feb. 24, 2003 issued in PCT/US02/18875 (WO02/103550).
AU Examiner's First Report dated Mar. 23, 2007 issued in AU 2002322096.
AU Examiner's Second Report dated Oct. 23, 2007 issued in AU 2002322096.
AU Notice of Opposition dated Apr. 6, 2009 issued in AU 2002322096.
AU Statement of Grounds and Particulars dated Jul. 3, 2009 issued in AU 2002322096.
AU Notice Opposition has been Withdrawn dated Aug. 19, 2009 issued in AU 2002322096.
European Supplementary Search Report dated Dec. 4, 2008 issued in EP 02 756 187.7- 2221.
European Examination Report dated Mar. 2, 2009 issued in EP 02 756 187.7- 2221.
RU Advisory Office Action dated May 31, 2006 issued in RU 2003136278/09.
RU Resolution on Granting dated Oct. 4, 2006 issued in RU 2003136278/09.
PCT International Search Report dated Mar. 13, 2008 issued in PCT/US2007/077714 (WO08/030928).
PCT International Preliminary Report on Patentability and Written Opinion dated Mar. 10, 2009 issued in PCT/US2007/077714 (WO08/030928).
EP Examination Report dated Jun. 24, 2009 issued in EP 07 841 947.0.
EP Examination Report dated Nov. 25, 2009 issued in EP 07 841 947.0.
Author unknown, "Call My Agent", *Business Week*, Mar. 6, 2000, p. 105.
Author unknown, "Smart Cubicles" *Business Week*, Mar. 6, 2000, p. 110.
Author unknown, "The Tube" *Business Week* Mar. 6, 2000, p. 106.
Gigaset CL4 SIMpad Siemens.com, description [Online] Jun. 25, 2001, XP002430870 Retrieved from Internet: URL:http://web.archive.org/web/20010625204821/www.mysiemens.com/MySiemens/CDA/Standard/Frameset/0.1649.3_SIMPADCL4_0_0_ 61_ 0,FF.html (3 pages).
Palermo, Vincent, "Near-filed magnetic comms emerges", Digital TV DesignLine.com, Oct. 31, 2003, Retrieved from Internet Aug. 1, 2006: URL:http://www.commsdesign.com/showArticle.jhtml?articleID=16502120 (5 pages).

* cited by examiner

WIRELESS GAME PLAYER

This application is a continuation and claims priority under 35 U.S.C. §120 from U.S. patent application Ser. No. 09/967,326, filed Sep. 28, 2001now U.S. Pat. No. 6,846,238, naming William R. Wells as inventor, and titled "Wireless Game Player" which is incorporated herein in their entirety and for all purposes.

BACKGROUND OF THE INVENTION

This invention relates to gaming machines such as video slot machines and video poker machines. More particularly, the present invention relates to methods and apparatus for providing portable remote gaming extensions to gaming machines.

Typically, utilizing a master gaming controller, a gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, including bill validators and coin acceptors, to accept money into the gaming machine and recognize user inputs from devices, including touch screens and button pads, to determine the wager amount and initiate game play. After game play has been initiated, the gaming machine determines a game outcome, presents the game outcome to the player and may dispense an award of some type depending on the outcome of the game.

As technology in the gaming industry progresses, the traditional mechanically driven reel slot machines are being replaced with electronic counterparts having CRT, LCD video displays or the like and gaming machines such as video slot machines and video poker machines are becoming increasingly popular. Part of the reason for their increased popularity is the nearly endless variety of games that can be implemented on gaming machines utilizing advanced electronic technology. In some cases, newer gaming machines are utilizing computing architectures developed for personal computers. These video/electronic gaming advancements enable the operation of more complex games, which would not otherwise be possible on mechanical-driven gaming machines and allow the capabilities of the gaming machine to evolve with advances in the personal computing industry.

To implement the gaming features described above on a gaming machine using computing architectures utilized in the personal computer industry, a number of requirements unique to the gaming industry must be considered. The gaming machine on the casino floor is a highly regulated device. It is licensed, monitored, taxed and serviced. Typically, within a geographic area allowing gaming, i.e. a gaming jurisdiction, a governing entity is chartered with regulating the games played in the gaming jurisdiction to insure fairness and to prevent cheating. For instance, in many gaming jurisdictions, there are stringent regulatory restrictions for gaming machines requiring a time consuming approval process of 1) new gaming hardware, 2) new gaming software and 3) any software modifications to gaming software used on gaming machines.

As an example of the regulation process, in many jurisdictions, to regulate gaming software on a gaming machine, a gaming software executable is developed and then burnt onto an EPROM. The EPROM is then submitted to various gaming jurisdictions for approval. After the gaming software is approved, a unique signature is determined for the gaming software stored on the EPROM using a method such as a CRC. Then, when a gaming machine is shipped to a local jurisdiction, the gaming software signature on the EPROM can be compared with an approved gaming software signature prior to installation of the EPROM on the gaming machine. The comparison process is used to ensure that approved gaming software has been installed on the gaming machine. After installation, an access point to the EPROM may be secured with evidence tape as a means of determining whether illegal tampering has occurred with the EPROM.

Besides regulating gaming hardware and software, a gaming jurisdiction may regulate many other aspects of gaming including where games of chance are played (e.g. casinos, stores, restaurants and other venues), who may participate in game play (e.g. enforcing age restrictions) and where regulated gaming machines may be located (e.g. particular areas of a casino). To obtain an operating license, a casino is required to adhere to the rules and regulations of the gaming jurisdiction in which it is located. Further, a licensed casino that fails to adhere to local gaming regulations may have its operating license revoked.

Currently, there is some desire by both game players and casino operators to expand game playing opportunities on gaming machines beyond the traditional casino floor area. For example, many game players would like to continue game play while performing an activity, such as getting a meal or going to a sports book, which requires them to leave the casino floor area where the gaming machines, by law, must be located. More specifically, a game player may want to take a break but may desire to continue playing a particular gaming machine because the player may consider the gaming machine is "lucky" or may believe the gaming machine is "due" for a win. In this situation, a casino may provide some players with the ability to reserve a gaming machine while they take a break to prevent other game players from playing the machine and spoiling their luck or winning the jackpot due on the gaming machine. However, casino operators are reluctant to provide a reservation service to most players because while a gaming machine is reserved it does not generate revenue for the casino and there is no guarantee the player will return.

In addition, to extend game playing opportunities beyond the casino floor, local gaming regulations must be carefully considered. For example, there have been attempts to place gaming machines into hotel rooms. All of these attempts have failed. A major factor in the failure of in-room gaming was the control of under-age players, i.e. preventing underage persons from gambling. Thus, in most jurisdictions there are laws against in-room game play.

In view of the above, it would be desirable to provide methods and apparatus for extending the opportunities for playing regulated gaming machine beyond traditional casino floor locations where gaming machines are generally located.

SUMMARY OF THE INVENTION

This invention addresses the needs indicated above by providing methods and apparatus for operating a wireless game player that presents a game of chance executed on a gaming machine in communication with the wireless game player. In one embodiment, the wireless game player is a hand-held mobile gaming device, electronically linked to a licensed gaming machine via a wireless connection. The wireless game player receives game inputs for a playing a game of chance from input mechanisms located on the wireless game player and displays game outcomes for games on chance on a display screen located on the wireless game player. However, all random number generation (RNG) events, game outcomes, meter information, game related information, and all cash transactions are maintained in the licensed (controlled) gaming machine and not the wireless game player. Thus, the wireless game player may be considered a remote extension of the licensed gaming machine.

The wireless game player may be used anywhere within the legal areas of the casino and it has the capability of identifying who is using it. For example, a biometric input device, such as a finger print reader may be used on the wireless game player to identify the player. Thus, the issue of under-age or excluded players is addressed.

One aspect of the present invention provides a hand-held wireless game player for playing a game of chance. The hand-held wireless game player may be generally characterized as including: 1) a wire-less communication interface; 2) a display screen; 3) one or more input mechanisms; and 4) a microprocessor configured i) to present the game of chance on the display screen using operating instructions received via the wireless communication interface from a master gaming controller located on a gaming machine and ii) to send information from input signals generated from the one or more input mechanisms to the master gaming controller via the wire-less communication interface. The wireless game player may be played in a plurality of venue locations physically separate from the location of the gaming machine where the plurality of venue locations are selected from the group consisting of a keno parlor, a bingo parlor, a restaurant, a sports book, a bar, a hotel, a pool area and a casino floor area. The game of chance played on the wireless game player may be selected from the group consisting of slot games, poker, pachinko, multiple hand poker games, pai-gow poker, black jack, keno, bingo, roulette, craps and a card game. Although, the present invention is not limited to these games.

In particular embodiments, the wireless communication interface may use a wireless communication protocol selected from the group consisting of IEEE 802.11a, IEEE 802.11b, IEEE 802.11x, hyperlan/2, Bluetooth, and HomeRF. The wireless game player may also comprise a wire network interface for connecting the wireless game player to a wire network access point. In addition, the wireless game player may also comprise a peripheral interface for connecting to a peripheral gaming device where the peripheral interface is a serial interface, a parallel interface, a USB interface, a FireWire interface, an IEEE 1394 interface. The peripheral gaming device may be a printer, a card reader, a hard drive and a CD-DVD drive.

In other embodiments, the one or more inputs mechanisms on the wireless game player may be selected from the group consisting of a touch screen, a input switch, an input button and biometric input device where the biometric input device may be a finger print reader. The wireless game player may also include a detachable memory interface designed to receive a detachable memory where the detachable memory unit stores graphical programs for one or more games chance played on the wireless game player. The wireless game player may also comprise one or more of the following: 1) an audio output interface for receiving a head phone jack, 2) an antenna, 3) a sound projection device, 4) a battery, 5) a power interface for supplying power to the wireless game player from an external power source and for charging the battery from the external power source, 6) a memory unit where the memory unit may store graphical programs for one or more games chance played on the wireless game player, 7) an electronic key interface designed to receive an electronic key, and 8) a video graphics card for rendering images on the display screen where the video graphics card may be used to render 2-D graphics and 3-D graphics.

In other embodiments, the microprocessor may be configured to present a bonus game on the display screen using instructions received from a master gaming controller on a gaming machine via the wireless communication interface. In addition, instructions received from the master gaming controller and the information sent to the master gaming controller may be encrypted. Further, the microprocessor may execute gaming logic for displaying a web-browser to the display screen. In addition, the wireless game player may be configured to present one or more of the following: an advertisement, news, stock quotes, electronic mail, a web page, a message service, a locator service or a hotel/casino service, a movie, a musical selection, a casino promotion, a broadcast event, a maintenance operation, a player tracking service, a drink menu and a snack menu.

Another aspect of the present invention provides a gaming machine for providing remote game play. The gaming machine may be generally characterized as comprising: 1) a master gaming controller designed or configured to generate game outcomes for one or more games of chance and to present remotely the game outcomes for the one or more games of chance on a wireless game player; and 2) the wireless game player where the wireless game player comprises: i) a wireless communication interface; ii) a display screen; iii) one or more input mechanisms; and iv) a microprocessor configured to present a game of chance on the display screen using operating instructions received from the master gaming controller via the wireless communication interface and to send information from input signals generated from the one or more input mechanisms to the master gaming controller via the wireless communication interface. The master gaming controller generally executes regulated gaming software to present the one or more games of chance. The wireless game player may be played in a plurality of venue locations physically separate from the location of the gaming machine where the plurality of venue locations are selected from the group consisting of a keno parlor, a bingo parlor, a restaurant, a sports book, a bar, a hotel, a pool area and a casino floor area.

In particular embodiments, the gaming machine may also comprise one or more gaming devices selected from a group consisting of lights, printers, coin hoppers, bill validators, ticket readers, card readers, key pads, button panels, display screens, speakers, information panels, player tracking devices and mass storage devices. In addition, the gaming machine may comprise, one or more display screens located in a main cabinet of the gaming machine. The gaming machine may also comprise one or more biometric input devices selected from the group consisting of a microphone, a camera, a finger print reader, hand writing input mechanism and a retinal scanner and gaming software logic for determining the identity of a game player using biometric information input using the one or more biometric input devices.

The gaming machine may also comprise a network interface where the network interface is used to communicate with one or more remote servers selected from the group consisting of a prize server, a game server, an entertainment content server, a cashless ticketing server, progressive game server, a bonus game server, a wireless game play server, a web-server and a money transfer server. The wireless communication interface may use a wireless communication protocol selected from the group consisting of IEEE 802.11a, IEEE 802.11b, IEEE 802.11x, hyperlan/2, Bluetooth, and HomeRF. The gaming machine may comprise gaming software logic for encrypting communications sent to the wireless game player and decrypting communications received from the wireless game player.

The gaming machine may generate game outcomes for games of chance selected from the group consisting of slot games, poker, pachinko, multiple hand poker games, pai-gow poker, black jack, keno, bingo, roulette, craps and card game. In addition, the master gaming controller may be designed or configured to present a bonus game on the wireless game player. The gaming machine may comprise gaming software logic for storing a game history record of games played on the wireless game player. In one embodiment, a first game of chance may be presented on the wireless game player and a second game of chance may be presented simultaneously on the one or more displays screens located in the main cabinet of the gaming machine. Further, the wireless game player may be used for additional activities such as to display an advertisement, news, stock quotes, electronic mail, a web page, a message service, a locator service or a hotel/casino service, a movie, a musical selection, a casino promotion, a broadcast event, a maintenance operation, a player tracking service, a drink menu and a snack menu.

Another aspect of the present invention provides a wireless game play system. The wireless game play system may be characterized as comprising: 1) a plurality of gaming machine designed to generate wireless game play sessions on wireless game players in communication with the gaming machines; 2) a plurality of wireless game players where each wireless game player is designed i) to communicate with at least one gaming machine and ii) to present a game of chance using instructions received from the gaming machine; and 3) a wireless game play network with at least one more wireless access points designed to transmit wireless communications to the plurality of wireless game players and designed to receive wireless communications from the wireless game players.

In particular embodiments, the wireless game play system may also comprise one or more of the following: a) one or more repeaters, b) one or more high-gain antenna, c) one or more storage cradles for the wireless game players where the one or more storage cradles further comprise a communication interface designed to connect the wireless game player to the wireless game play network, d) one or more wireless game play kiosks designed to provide wireless game play services, e) one or more gaming machines connected to said wireless game play network designed to provide only wireless game play sessions and f) one or more wireless game play servers. In addition, the wireless game play network may be connected to one or more network interfaces. The one or more network interfaces may be used to communicate with one or remote servers selected from the group consisting of a prize server, a game server, an entertainment content server, a cashless ticketing server, progressive game server, a bonus game server, a wireless game play server, a web-server and a money transfer server.

Another aspect of the present invention provides a method, in a gaming machine, of generating a wireless game play session on a wireless game player in communication with the gaming machine. The method may be generally characterized as comprising: 1) establishing communications with the wireless game player; 2) receiving a message from the wireless game player requesting the gaming machine to initiate a game of chance; 3) generating a game outcome for the game of chance; and 4) sending operating instructions to the wireless game player where the operating instructions are used by the wireless game player to present the game outcome for the game of chance. The communications between the gaming machine and the wireless game player may use a wireless communication protocol selected from the group consisting of IEEE 802.11a, IEEE 802.11b, IEEE 802.11x, hyperlan/2, Bluetooth, and HomeRF.

In particular embodiments, the method may include one or more of the following: a) reserving the gaming machine for wireless game play, b) receiving a request from the wireless game player to select a game of chance to be played on the wireless game player, c) prior to establishing communications with the wireless game player, selecting a game of chance on the gaming machine, d) receiving a message containing a wager amount for the game of chance, e) receiving a message containing information from input signals generated on one or more input mechanisms located on the wireless game player, e) generating an encrypted message and sending the encrypted message to the wireless game player, f) receiving an encrypted message from the wireless game player and decrypting the encrypted message, g) initiating a player tracking session, h) adding credits to the gaming machine, i) storing a game history of games played on the wireless game player during the wireless game play session, j) generating a bonus game outcome and sending operating instructions to wireless game player used to present the bonus game outcome on the wireless game player, k) sending metering information generated during the wireless game play session to a player tracking server, l) authenticating the identity of a player using the wireless game player where the identity of the player is authenticated using biometric information received from the player and k) terminating the wireless game play session. In addition, the method may comprise sending entertainment content to the wireless game player where the entertainment content is selected from the group consisting of an advertisement, news, stock quotes, electronic mail, a web page, a message service, a locator service or a hotel/casino service, a movie, a musical selection, a casino promotion, a broadcast event, a player tracking service, a drink menu and a snack menu.

Another aspect of the present invention a method of generating a wireless game play session provides in a wireless game player in communication with a gaming machine. The method may be characterized as comprising: 1) establishing communications with the gaming machine; 2) receiving an input signal to initiate a game of chance from an input mechanism located on the wireless game player; 3) sending a message to the gaming machine indicating a game of chance has been initiated on the wireless game player; and 4) displaying a game outcome for the game of chance. The method may also comprise displaying entertainment content on the wireless game player wherein the entertainment content is selected from the group consisting of an advertisement, news, stock quotes, electronic mail, a web page, a message service, a locator service or a hotel/casino service, a movie, a musical selection, a casino promotion, a broadcast event, a player tracking service, a drink menu and a snack menu.

In particular embodiments, the method may include one or more of the following: a) receiving a message containing the game outcome generated on the gaming machine, b) generating a graphical presentation of the game outcome for the game of chance, c) booting the wireless game player, d) enabling game play on the wireless game player, d) receiving a game selection and sending the game selection to the gaming machine, e) receiving a wager amount for the game of chance and sending the wager amount to the gaming machine, f) receiving input signals from one or more input mechanisms located on the wireless game player and sending information from the input signals to the gaming machine, g) generating an encrypted message and sending the encrypted message to the gaming machine, h) receiving an encrypted message from the gaming machine and decrypting the encrypted message, i) receiving authentication information for a player using the wireless game player such as biometric information, a PIN number and a password, j) sending the authentication information to the gaming machine, k) receiving a message containing a bonus game outcome generated on the gaming machine and l) generating a graphical presentation of the bonus game outcome and displaying the graphical presentation of the bonus game outcome.

Another aspect of the invention pertains to computer program products including a machine-readable medium on which is stored program instructions for implementing any of the methods described above. Any of the methods of this invention may be represented as program instructions and/or data structures, databases, etc. that can be provided on such computer readable media.

These and other features of the present invention will be presented in more detail in the following detailed description of the invention and the associated figures.

DESCRIPTION OF THE PREFERRED EMBODIMENTS

Figure 1:
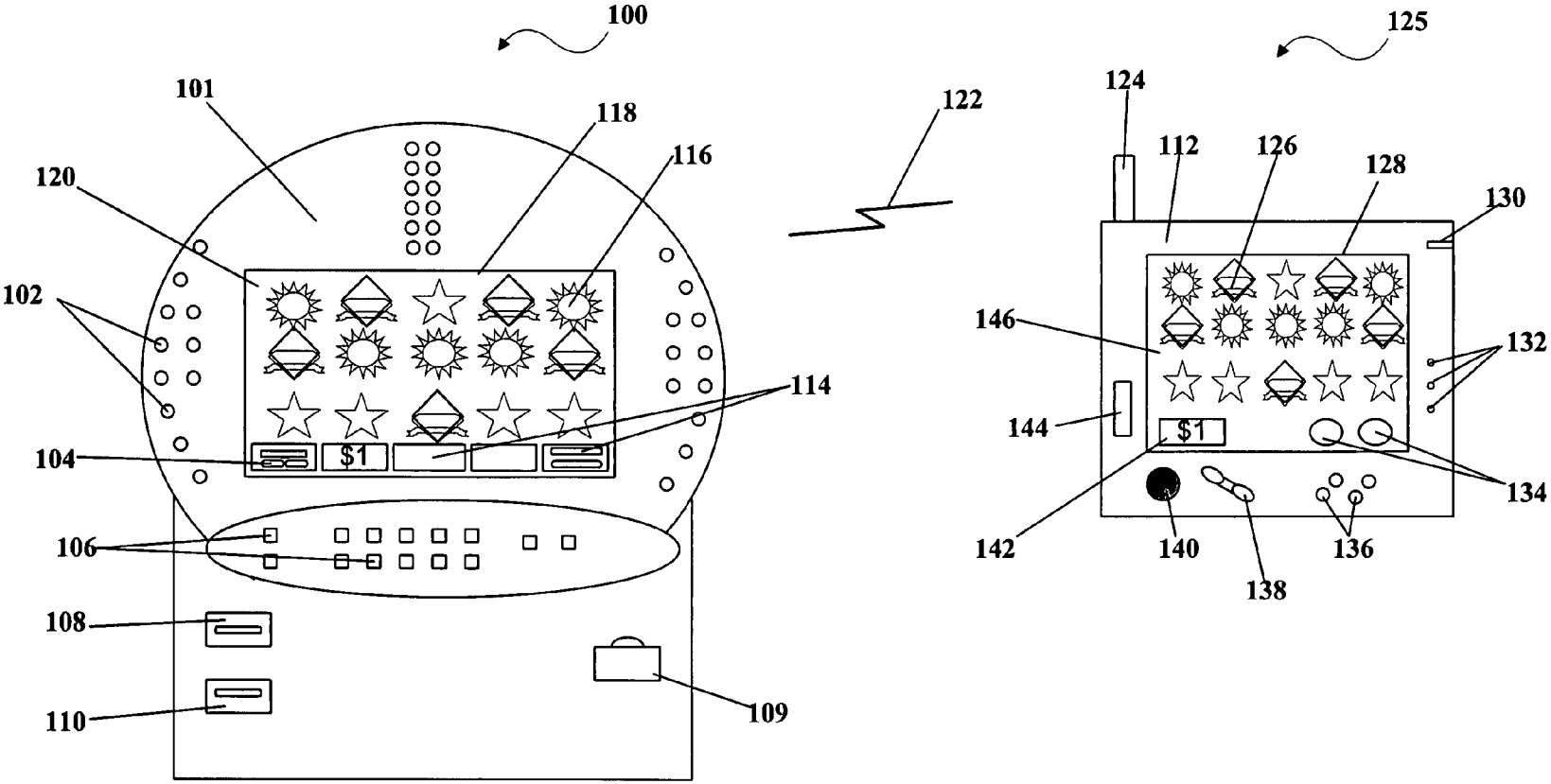
FIG. 1 is block diagram of a gaming machine in communication with a wireless game player.

FIG. 1 is block diagram of a gaming machine 100 in communication with a wireless game player 125. In the present invention, the wireless game player 125 is used as a remote extension to extend the game playing capabilities of gaming machine 100. Game outcomes for games of chance generated using licensed and regulated gaming software executed on the gaming machine 100 may be presented on the wireless game player 125 at remote locations from the gaming machine 100. Thus, a game generated on a gaming machine 100 may be presented on a display 118 located on the main cabinet 101 of the gaming machine and played using input mechanisms located on the main cabinet of the gaming machine. In addition, the game generated on the gaming machine may be presented on a display 128 located on a wireless game player in communication with the gaming machine and played with input mechanisms located on the wireless game player.

As an example game play on gaming machine 100 with the present invention, a game 116 may be presented on a display 118 located on gaming machine 100. The game 116 may be played using input mechanisms, such as input buttons 106 or touch screen interface buttons 104. The touch screen interface buttons 104 are activated using a touch screen 120 located over the display 118 of the gaming machine 100. Further, a game 126 may be presented on display 128 located on the wireless game player 125. The game 126 may be played using input mechanisms located on the wireless game player 125, such as 138 and 136 or touch screen interface buttons 134. The touch screen interface buttons 134 are activated using the touch screen 146 located over the display 128.

The game logic for a game presented on display 118 or display 128 is stored within the main cabinet 101 of the gaming machine 100. The game logic, which is typically regulated gaming software, is executed by a master gaming controller (see FIG. 3) located within the main cabinet 101 of the gaming machine 100. A particular game executed by the master gaming controller may be presented on display 118 or, when the wireless game player 125 is activated, on display 128. In some embodiments of the present invention, when the same game is presented on display 118 or on display 128, the graphical presentations of the game may vary between the displays because of hardware differences. For instance, display 118 may by larger than display 128 allowing for higher resolution graphical output on display 118 as compared to display 128.

While playing a game 126 on the portable wireless game player 125, a player may move throughout the areas of a casino where wireless game play is enabled. For instance, a player may be able to play the game 126 with the wireless game player 125 in a restaurant, a keno parlor or a sports book. The player's position does not have to remain static while playing the game 126 on the wireless game player 125 and the player may be actively moving while games are played on the wireless game player 125.

When a game is played on the wireless game player of the present invention, such as 125, all random number generation (RNG) events, game outcomes, meter information, game related information, and all cash transactions are generated and maintained in the licensed (controlled) gaming machine (e.g. 100), and not the wireless game device. Thus, the wireless game player 125 may be considered a remote extension of the gaming machine's 100 display and input mechanisms. With a gaming machine with a remote extension, the gaming machine may operate in both a local mode and a remote mode. In the local operational mode, game play is presented using the display and input mechanisms located on the gaming machine. In the remote operational model, game play is presented using the display and input mechanisms located on the wireless game player. These two operational modes are described as follows.

During local game play on a gaming machine, a player may input money or indicia of credit into the gaming machine, indicate a wager amount, and initiate a game play. For example, to play the slot game 116 on gaming machine 100, a player may deposit money or indicia of credit using the bill validator 108, the card reader 110 or the coin acceptor 109. Status information 114 for the game, such as a game denomination and available credits may be displayed on display 118. Next, using input buttons 106 and touch screen interface buttons 104, the player may make a wager and initiate the game. The gaming machine determines a game outcome and then presents the game outcome to player on the display 118. For instance, after a slot game has been initiated, the video gaming machine calculates the final position of the reels (e.g. the game outcome), the reels on display 118 spin and then stop at pre-determined position. Based on the pre-determined outcome calculated by the master gaming controller, an award may be presented to the player. As another example, after a card game has been initiated, the video gaming machine 100 calculates a sequence of cards to be dealt to the player and card hands are dealt on the display 118. During the card game play, the player may use input mechanisms on the gaming machine 100 to hold or discard cards. After the card game is complete, an award may be presented to the game player.

The games presented on the gaming machine 100 may be enhanced by additional features. Light patterns, such as from lights 102, and sounds may be generated on the gaming machine 100 to enhance the game outcome presentation. In addition, during certain game events, a bonus game may be presented to the game player.

During remote game play on a gaming machine using a wireless game player such as 125, a player may input money or indicia of credit into the gaming machine, activate a wireless game player, indicate a wager amount on the wireless game player and initiate a game play on the wireless game player. For example, to play the slot game 126 on gaming machine 100 using the wireless game player 125, a wireless game play session is requested by the player. A wireless game play session may include one or more game plays on a wireless game player 125 connected to the gaming machine 100 via a wireless communication link 112. The wireless game play session request by the player may be made using an input mechanisms located on the gaming machine.

Prior to beginning, the wireless game play session, a player may be required to deposit money or indicia of credit to in the gaming machine in communication with the wireless game player. The deposited credits may be used during the wireless game play session. For instance, using the bill validator 108, the card reader 110 or the coin acceptor 109 located on the gaming machine 100, the player may provide an initial amount of credits to be used for a wireless game play session using the wireless game player 125. During game play on the wireless game player, a player wagers a certain amount of credits per game. Depending on the outcome of a particular game, the number of credits available for game play may be decreased or may be increased.

In some embodiments, after a game player has used all of their credits during a wireless game play session and the player desires to continue the wireless game play session, the player may be required to return to the gaming machine to add additional credits. In other embodiments (See FIG. 3), a card reader or other input device may be attached to the wireless game player 125 and used to add credits to the gaming machine 100. For instance, a player may be able to enter a credit card number or debit card number and transfer funds to the gaming machine to be used as game credits via a touch screen interface on the wireless game player 125. Further, the wireless game player may include a card reader for scanning a magnetic strip on the debit card or credit card.

After establishing game credits on the gaming machine, the wireless game player 125 is activated. In some embodiments, authentication and verification of the user of the wireless game player is performed. For example, to enforce age restrictions imposed by a jurisdiction, the user may be verified and authenticated to use the game player. The wireless game player may have a biometric sensor (not shown) such as a fingerprint sensor. As part of the authentication process, the player may be asked to place their finger on the sensor located on located on the wireless game player. The fingerprint image is sent back to the controller in the machine for comparison. As another example, the wireless game player may include a smart-card reader that reads biometric smart cards (cards having a built-in fingerprint sensor). The smart card has all the personal information of the casino guest. Thus, the authentication could occur directly at the wireless game player. A description of a finger print reader as an identification device is provided in co-pending U.S. application Ser. No. 09/172,787, filed Oct. 14, 1998, by Wells, et al., entitled "Gaming Device Identification method and Apparatus," which is incorporated herein in its entirety and for all purposes. Other types of verification methods such as a PIN number or a password may be used separately or in combination with biometric identification methods. Other biometric identification methods that may be used with the present invention include but are not limited to feature identification using a camera, retinal pattern identification using a retinal scanner, voice pattern identification input using a microphone and hand-writing recognition using a hand writing input pad.

For security, the wireless game player has an encrypted serial number (code), which is used to verify and authenticate the wireless game player. For additional security, an electronic key may be used with the device. With an electronic key system, the wireless game player device can not be activated until the key is inserted into a receptacle on the game player. In addition, the wireless game player may have a small GPS (Global Positioning System) device to verify location of the device. Position verification may be used to insure the wireless game player is used only in legal gaming areas of the casino and to track lost or stolen devices. When the gaming machine detects that the wireless game player is in a restricted area, it may discontinue communications with the wireless game player. Further, the wireless game player may have an RF capacitive device built into the wireless game player. RF capacitive devices are often used in retail stores to prevent theft. When the wireless game player is passed through a protected doorway, an alarm may be sounded even when the power is off to the wireless game player. Other security features may be used on the wireless game player and are not limited to electronic keys, GPS sensors or RF capacitive devices described above.

Verification and authentication may be required to start every wireless game play session. Further, there may be a non-play time limit. Once this time is exceeded, a verification and authentication cycle or process must be performed. The verification and authentication cycle may be performed for the player and the wireless game player, for only the player or for only the wireless game player. As another example, authentication and verification may be required after a certain number of games played on the gaming device or may be even be required at random intervals. When verification and authentication requirements are not satisfied during a wireless game play session, the game play session will typically be terminated.

In one embodiment of the present invention, after the wireless game player is activated 125, the input mechanisms, such as the touch screen 120 and the input buttons 106, built into the gaming machine 100 are deactivated and a wireless game play session may begin. The display 118 on the gaming machine 101 may display an "out of order" message, an "operator" message or the display 118 may be blank to indicate the gaming machine is unavailable for game play. During remote game play on the wireless game player 125, gaming information necessary to present the game on the wireless game player, such as a graphical presentation of game outcome and meter information, is generated on the gaming machine 100 are transmitted to the wireless game player via wireless communication 122. The mathematical methods used to generate the game outcomes remain on the gaming machine 100. Further, gaming information required by the gaming machine 100 to the determine the game outcome, such as signals from input mechanisms located on the wireless game player, are transmitted from the wireless game player 125 to the gaming machine 100 via wireless communication 122.

During game play on the wireless game player 125, status information 142 for the game 126, such as a game denomination and available credits may be displayed on display 128. The status information 142 and the game 126 displayed on the wireless game player 125 may appear similar to what is displayed on the gaming machine 101 but is not necessarily identical to what is displayed on the gaming machine 100. Next, using input buttons, such 134, 136 and 138, the player may make a wager and initiate the game. In one embodiment of the present invention, the touch screen interface buttons 134 may be based on a web-browser interface.

After a game has been initiated on the wireless game player 125, via antenna 124, a wireless communication 122 containing the wager and initiate game inputs is sent to the gaming machine 100. In response, to the wager and the initialization of a game, the gaming machine 100 generates a game outcome including an award and possibly a bonus game. Instructions for displaying the game outcome and bonus game are sent in one or more wireless communications 122 to the wireless game player 125. The one or more wireless communications may be a series of information packets. The format of the information packets will vary according to the wireless communication standard used. Details of a wireless network for providing wireless communications is described with respect to FIG. 4.

To illustrate the play of a particular game, a slot game and a card game are described. However, the present invention is not limited to these games as nearly any type of game that can be played on a video gaming machine may also be played on the wireless game player 125. When a slot game 126 has been initiated on the wireless game player 125, the gaming machine 100 calculates the final position of the reels (e.g. the game outcome). The gaming machine may send instruction to the wireless game player to spin the reels on display 128 spin and then stop the reels at a pre-determined position. Based on the final position of the reels calculated by the master gaming controller located on gaming machine 100, an award may be presented to the player. In addition, during certain game events, a bonus game may be presented to the game player as part of the slot game. As another example, after a card game has been initiated on the wireless game player 125, the video gaming machine 100 calculates a sequence of cards to be dealt. The gaming machine 100 sends wireless communications 122 to the wireless game player 125 indicating card hands to be dealt on the display 128. During the card game play, the player may use input mechanisms on the wireless game player 125 to hold or discard cards. After the card game is complete, an award may be presented to the game player. A bonus game may also be incorporated into the card game.

When a customer does not wish to use the wireless game player 125 anymore, the customer can terminate the wireless game play session using the touch screen 146 and deactivate the wireless game player 125. As described above, the wireless game player 125 may automatically terminate a wireless game play session and deactivate itself after a period of inactivity. After roaming with the wireless game player 125, the customer may return to the gaming machine providing the wireless game play session and wish to resume play on the main display of the gaming machine. In this case, the customer may depress a "return" button on the wireless game player 125 and after a verification cycle the player can begin playing at the gaming machine again.

The games presented on the wireless game player 125 may be enhanced by additional features. For instance, light patterns and sounds from the audio output 140 may be generated to enhance the game outcome presentation and add excitement to the games played on the wireless game player 125. Further, the wireless game player may include an audio output interface for connecting head phones. As part of a game outcome presentation, sounds may be transmitted through the audio output interface to head phones worn by the game player.

Details of the wireless game player hardware are now described. The wireless game player 125 is generally a hand-held device. It consists of a housing 112, display 128, touch screen 146, switch panel 144, battery, wireless communication interface, and controller. In one embodiment of the present invention, a modified DT Research WebDT pad (DT Research, Inc., Milpitas, Calif.) is used as a wireless game player. However, the present invention is not limited to the DT research WebDT pad as other hand-held wireless devices such as personal digital assistants (PDA) may also be used.

In one embodiment, the wireless game player may be approximately 10.5×9.5×1.0 inches in size, weigh 3 pounds and use a 10.4 inch color LCD touch screen display. Typically, an 8 inch to 10.4 inch display provides a sufficient viewing area without reducing the size of the character fonts to a point where they are unreadable by most players. The touch screen (sensor) 146 is overlaid on the displayable surface of the LCD 128. Other display technologies can be used instead of LCD, plus some display technologies will incorporate a built-in touch screen (internal vs. external). To activate the touch screen 146, a stylus 130 may be used, but most people will use their fingers.

Audio is available via the small built-in speaker 140 or an external headset. Lighting schemes, such as arrays of LEDs, may be added to the wireless game player 125 to provide visual effects and to communicate status information to a game player. Status information, such as a battery level and connection status, may be provided by the status lights 132. The layout and number of the input buttons, including 138 and 136, is variable. In FIG. 1, the configuration of the input buttons on the gaming machine 100 and wireless game player are different. In one embodiment of the present invention, the input buttons on the wireless game player 125 may be configured in a manner similar to input buttons located on the gaming machine. Further, other devices on the wireless game player, such as the audio output 140, the status lights 132, the antenna 124 and the on/off switch 144 may be located at other locations on the housing 112 depending on the design of the wireless game player.

In one embodiment, the battery will last 5 hrs between charging. Charging of the wireless game player may be accomplished by setting the wireless game player in a special storage cradle. The cradles may be in the form of storage bins located in a special area, located at the gaming machine or built as holders located on a desk, counter or table. For instance, a storage cradle for charging the wireless game player may be located in a keno parlor, restaurant tables or sports book. When the wireless game player is placed in a storage cradle it may used while being charged.

In a particular embodiment, the wireless game player 125 uses an IEEE 802.11b compliant wireless interface. It is a 2.4 Ghz Direct Sequence Spread Spectrum radio system. It has a range of up to 330 fit (inside) from any access point. The data rate is 11 Mbps. IEEE 802.11b is a commonly used radio standard, but the present invention is not limited to this standard. Other wireless standards that may be used include IEEE 802.11a, IEEE 802.11x, hyperlan/2, Bluetooth, IrDA, and HomeRF.

In the example above, local gaming and remote gaming on gaming machine 100 has been described in a mutually exclusive manner. Therefore, when local gaming is enabled, remote gaming is disabled and when remote gaming is enabled, local gaming is disabled. The present invention is not so limited. Gaming machines that support only remote gaming and not local gaming may be used with the present invention. These gaming machines (see FIG. 4) may be located away from the casino floor. Further, a gaming machine may support simultaneously a plurality of remote gaming devices for game play and not just a single remote gaming device. Finally, gaming machine may be used that simultaneously provide both remote game play and local game play. For instance, one game player may use a gaming machine for local play while another game player is using a wireless game player connected to the gaming machine to play remotely.

Figure 2:
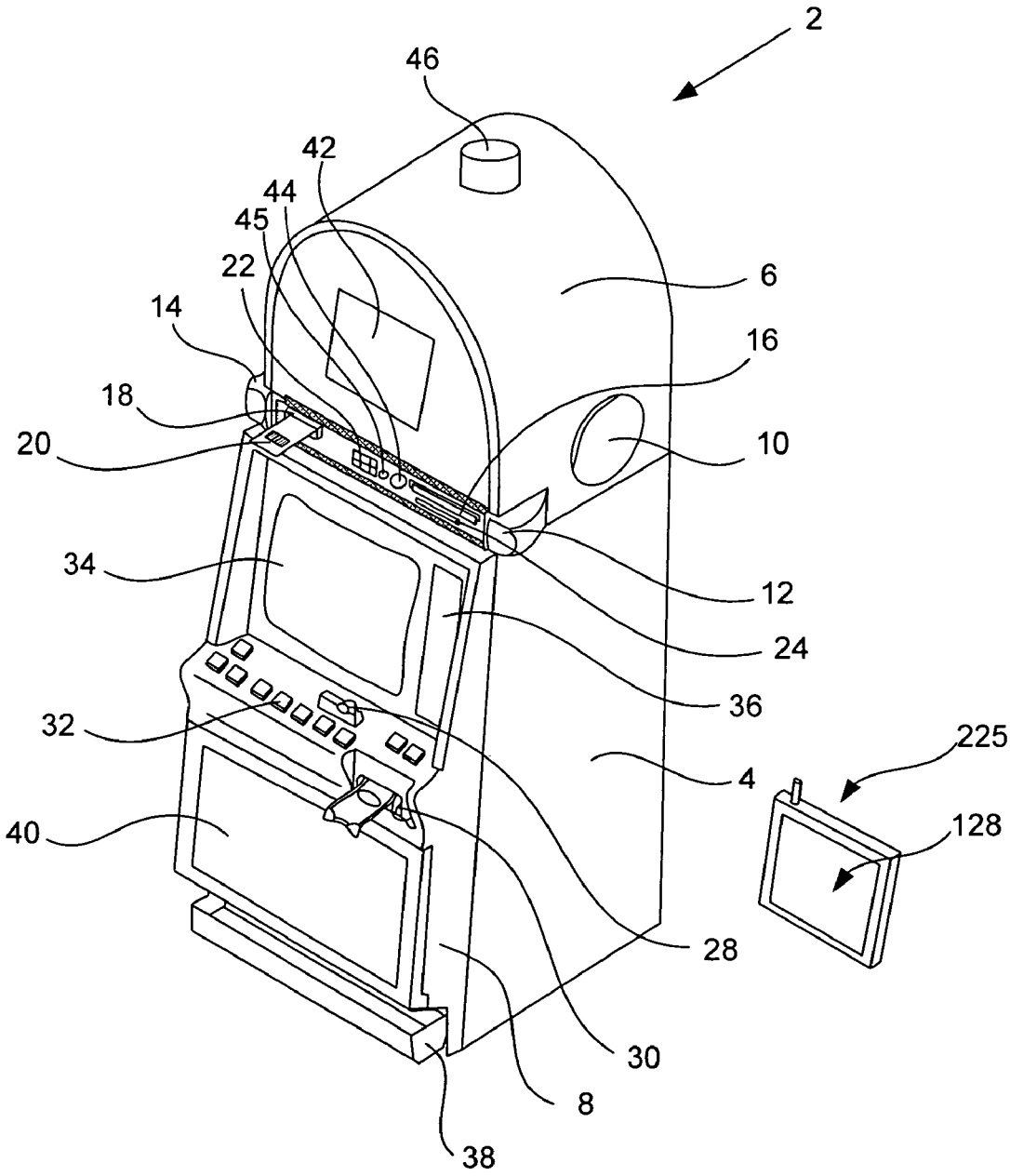
FIG. 2 is a perspective drawing of a gaming machine having a top box and other devices.

In FIG. 2, another video gaming machine 2 of the present invention is shown. In FIG. 2, more details of a gaming machine as well as additional gaming services that may be provided with a gaming machine providing remote game play sessions are described. For instance, player tracking services may be provided on gaming machines of the present invention and player tracking points may be accumulated during a wireless game play session. Further, using a player tracking device located on a gaming machine, a player may be able to request a wireless game player for use in a wireless game play session.

Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The main display monitor 34 will typically be a cathode ray tube, high resolution flat-panel LCD, or other conventional electronically controlled video monitor. The gaming machine 2 includes a top box 6, which sits on top of the main cabinet 4. A second display monitor 42 may be provided in the top box. The second display monitor may also be a cathode ray tube, high resolution flat-panel LCD or other conventional electronically controlled video monitor. In addition, the gaming machine 2 is designed to communicate to the wireless game player 125 with display 126. The wireless game player 125 provides a remote extension to gaming machine 2.

Figure 3:
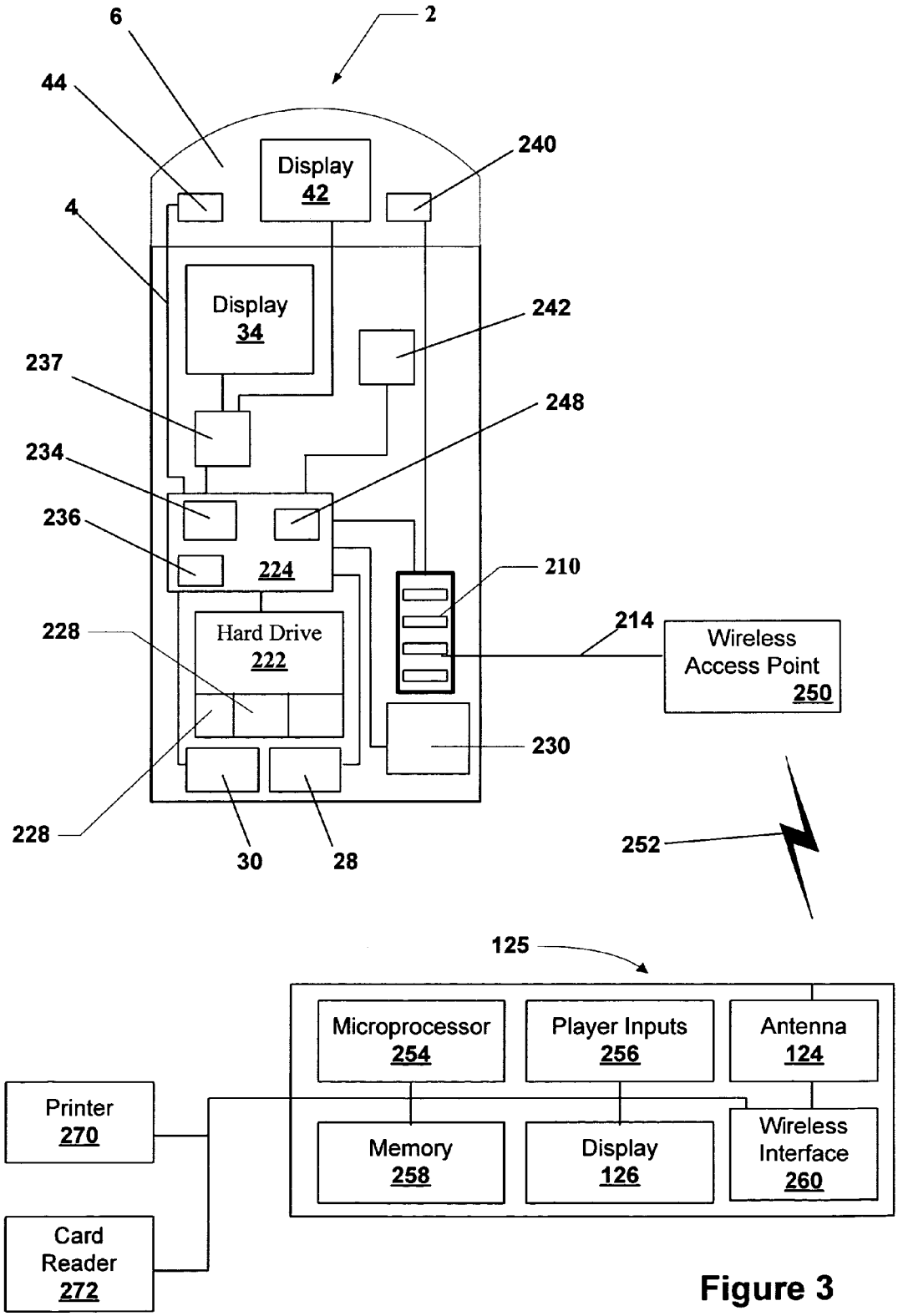
FIG. 3 is a block diagram of the internal components of a gaming machine and internal components of a wireless game player.

Typically, after a player has initiated a game on the gaming machine, one purpose of the main display monitor 34, the second display monitor 42 or the remote display 126 is the visual display of a game outcome presentation, including bonus games, controlled by a master gaming controller 224 (FIG. 3). Also, the main display monitor 34, the second display monitor 42 and the remote display 126 may also be utilized to display entertainment content independent of the game outcome presentation. For example, broadcast events, including television programming, may be provided to the main display monitor 34, the secondary display monitor 42 or the remote display 126. The broadcasts events may be sent to the gaming machine 2 via a cable link or other suitable link from outside of the gaming machine. All or some subset of the programming provided by a television broadcaster may be displayed as entertainment content on one or more of the video displays.

Television programming content of particular interest to casino operators and game players may include, for example, sporting events, talk shows, game shows, soap operas, advertisements, situation comedies, etc. In addition, broadcasts of competitive events on which the player can wager may be displayed. For example, dog racing or horse racing events may be displayed as content on the remote display 125. In such events, there is typically a rather long down time between races. During this period, the player may play the wireless game player 125 connected to the gaming machine. Also, the television programming entertainment content may be displayed while a player is engaged in playing a game on the wireless game player 125 or between games. Similarly, the entertainment content may include information available on the Internet, including the World Wide Web, for more technologically sophisticated players.

Returning to the gaming machine in FIG. 2, the information panel 36 may be a back-lit, silk screened glass panel with lettering to indicate general game information including, for example, the number of coins played. The bill validator 30, player-input switches 32, video display monitor 34, and information panel are devices used to play a game on the game machine 2 including the wireless game player 125. The devices are controlled by a master gaming controller (see FIG. 3), housed inside the main cabinet 4 of the machine 2. Many possible games, including traditional mechanical slot games, video slot games, video poker, video pachinko, multiple hand poker games, video pai-gow poker, video black jack, video keno, video bingo, video roulette, video craps, video card games and general games of chance, may be provided with gaming machines of this invention. These games may be played using the wireless game player 125.

General games of chance refer to games where a player makes a wager on an outcome of the game. The outcome of the game of chance may be affected by one or more decisions may be the player. For instance, in a video card game, the player may hold or discard cards which affects the outcome of the game.

The top box 6 houses a number of devices, which may be used to add features to a game being played on the gaming machine 2, including speakers 10, 12, 14, a ticket printer 18 which may print bar-coded tickets 20, a key pad 22, a florescent display 16, a camera 45, microphone 44 and a card reader 24 for entering a magnetic striped cards. The speakers may be used to project sound effects as part of a game outcome presentation. The key pad 22, the florescent display 16 and the card reader 24 may be used for to enter and display player tracking information. As another example, the player may enter playing tracking information and identification information using the card reader 24 and the main video display 34 where the main video display may be used as a touch screen to enter information. Player tracking information may be entered into the gaming machine before a player initiates a game on the gaming machine. Typically, the player's incentive to enter player tracking information into the gaming machine 2 is potential rewards related to the amount of a player's game play.

The top box also includes a candle 46. The candle is a light that may be activated by the master gaming controller on the gaming machine. In one embodiment, an antenna (not shown) may be installed in the candle. The antenna may be used to provide wireless game play sessions to one or more wireless game players in communication with the gaming machine 2 via the antenna.

In addition to enabling player tracking services, the key pad 22, the florescent display 16 and the card reader 24 may be used to enter identification information that enables a player to access entertainment content or receive personal messages on the gaming machine independent of a game play and game outcome presentation on the gaming machine 2. For example, a player may enter a personal identification number into the gaming machine 2 using the key pad 22 that allows the player to receive entertainment content such as viewing a movie or a broadcast event. As another example, after entering the personal identification number, the player may be allowed to receive a personal message indicating a table is ready at a restaurant in the casino or to receive a personal message containing information on a sporting event such as a score of personal interest to the player utilizing the gaming machine.

In one embodiment of the present invention, the player tracking services and related gaming service described above may be provided via a touch screen interface on the wireless game player 125. For instance, the wireless game player 125 may include a card reader for reading a player tracking card and player tracking identification information may be provided via a touch screen interface on the wireless game player. Further, the player may be able to access player tracking information using the wireless game player 125.

In addition to the devices described above, the top box 6 may contain different or additional devices than shown in the FIG. 2. For example, the top box may contain a bonus wheel or a back-lit silk screened panel which may be used to add bonus features to the game being played on the gaming machine. During a game, these devices are controlled and powered, in part, by circuitry (not shown) housed within the main cabinet 4 of the machine 2. Understand that gaming machine 2 is but one example from a wide range of gaming machine designs on which the present invention may be implemented. For example, not all suitable gaming machines have top boxes or player tracking features. Further, some gaming machines have two or more game displays—mechanical and/or video, while others are designed for bar tables and have displays that face upwards. As another example, a game may be generated in on a host computer and may be displayed on a remote terminal or a remote computer. The remote computer may be connected to the host computer via a network of some type such as the Internet. Those of skill in the art will understand that the present invention, as described below, can be deployed on most any gaming machine now available or hereafter developed.

Returning to the example of FIG. 2, when a user selects a gaming machine 2, he or she inserts cash through the coin acceptor 28 or bill validator 30. Additionally, the bill validator may accept a printed ticket voucher which may be accepted by the bill validator 30 as an indicia of credit. Once cash has been excepted by the gaming machine, it may be used to play a game on the gaming machine. Typically, the player may use all or part of the cash entered into the gaming machine to make a wager on a game play. Depending on the amount of the wager on a game or for a fee, a player may be able to access various entertainment content sources for a length of time. For example, a wager on a game above a certain threshold amount may enable a player to watch a broadcast event or to access the World Wide Web for up to 5 minutes after each wager on the gaming machine 2. In addition, cash or indicia of credit entered into the gaming machine may be used to purchase entertainment content independent of a wager made on a game on the gaming machine. For example, for a 10 dollar fee, a player may view a movie on the gaming machine. While watching the movie on the gaming machine, the player may play games on the gaming machine 2 or the wireless game player 125 or just watch the movie.

During the course of a game, a player may be required to make a number of decisions which affect the outcome of the game. For example, a player may vary his or her wager, select a prize, or make game-time decisions which affect the game play. These choices may be selected using the player-input switches 32, the main video display screen 34 or using some other device which enables a player to input information into the gaming machine including a key pad, a touch screen, a mouse, a joy stick, a microphone and a track ball.

When a game is not being played on the gaming machine or during particular game operational modes, the player may select an entertainment content source using the above mentioned inputs where the entertainment content is independent of a game being played on the gaming machine. The entertainment content source may include, for instance, a CD player, an FM/AM tuner, a VHS player, a DVD player, a TV tuner, a musical jukebox, a video jukebox, a computer, a server and a media software application. It will be appreciated, however, that any information source may be utilized. Entertainment content from these sources may be selected and displayed on the wireless game player 125. For instance, a player may listen to music from the FM/AM tuner via headphones connected to the wireless game player.

Before playing a game, a player may select the video jukebox, which may contain a DVD player loaded with many DVDs, as the entertainment content source and preview a movie on at least one of the display screens on the gaming machine 2. The DVDs may be stored on the gaming machine 2 or in a central location separate from the gaming machine. The visual display of the output from the video jukebox may be viewed by the player on the main video display screen 34, the secondary video display screen 42 or the remote display 126. The sound for the movie may be projected by the speakers 10, 12 and 14 on the gaming machine or a player may listen to the movie through headphones. As described above, the wireless game player 125 may include an interface for audio output such as a headphone jack.

The game player may also use the player input switches 32, key pad 22, and other input devices to control a feature of the entertainment content. For example, when the entertainment content is a movie, the player input switches 32 and key pad may be operated to fast forward, stop or pause the movie. When the entertainment content is accessing the World Wide Web through a web-browser, the player input switches 32 and key pad may be used to operate the web-browser. Input switches, as described with respect to FIG. 1, on the wireless game player 125 may also be used to control these functions.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18. When a player is using the wireless game player 125, credits available during the wireless game play session are stored on the gaming machine. To redeem credits, for instance to receive a printed ticket voucher, the player may have to return to the gaming machine 100 or a printing station supporting communications with the wireless game player 125. In some embodiments of the present invention, a player may be able to electronically transfer credits to a remote account accessible by the player.

FIG. 3 is a block diagram of the internal components of a gaming machine 2 and a wireless game player 125. Components that appear in FIGS. 1 and 2 are identified by common reference numerals. A master gaming controller 224 controls the operation of the various gaming devices and the game presentation on the gaming machine 2. In the present invention, the wireless game player 125 is one of the gaming devices the master gaming controller 224 controls. The master gaming controller 224 may communicate with the wireless game player 125 via a wireless communication link 252. The wireless communication link may use a wireless communication standard such as but not limited to IEEE 802.11*a*, IEEE 802.11*b*, IEEE 802.11*x*(e.g. another IEEE 802.11 standard such as 802.11*c* or 802.11*e*), hyperlan/2, Bluetooth, and HomeRF.

As described above, in the present invention, the gaming machine may operate in a local operational mode where a game is presented on a local display screen, such as 32 or 42, a remote operational mode where a game is presented on the wireless game player 125 or combinations thereof. When the gaming machine 2 is in a local operational mode, using a game code and graphic libraries stored on the gaming machine 2, the master gaming controller 224 generates a game presentation which is presented on the displays 34 and 42. The game presentation is typically a sequence of frames updated at a rate of 60 Hz (60 frames/sec). For instance, for a video slot game, the game presentation may include a sequence of frames of slot reels with a number of symbols in different positions. When the sequence of frames is presented, the slot reels appear to be spinning to a player playing a game on the gaming machine. The final game presentation frames in the sequence of the game presentation frames are the final position of the reels. Based upon the final position of the reels on the video display 34, a player is able to visually determine the outcome of the game.

Each frame in sequence of frames in a game presentation is temporarily stored in a video memory 236 located on the master gaming controller 224 or alternatively on the video controller 237. The gaming machine 2 may also include a video card (not shown) with a separate memory and processor for performing graphic functions on the gaming machine. Typically, the video memory 236 includes 1 or more frame buffers that store frame data that is sent by the video controller 237 to the display 34 or the display 42. The frame buffer is in video memory directly addressable by the video controller. The video memory and video controller may be incorporated into a video card which is connected to the processor board containing the master gaming controller 224. The frame buffer may consist of RAM, VRAM, SRAM, SDRAM, etc.

The frame data stored in the frame buffer provides pixel data (image data) specifying the pixels displayed on the display screen. In one embodiment, the video memory includes 3 frame buffers. The master gaming controller 224, according to the game code, may generate each frame in one of the frame buffers by updating the graphical components of the previous frame stored in the buffer. Thus, when only a minor change is made to the frame compared to a previous frame, only the portion of the frame that has changed from the previous frame stored in the frame buffer is updated. For example, in one position of the screen, a 2 of hearts may be substituted for a king of spades. This minimizes the amount of data that must be transferred for any given frame. The graphical component updates to one frame in the sequence of frames (e.g. a fresh card drawn in a video poker game) in the game presentation may be performed using various graphic libraries stored on the gaming machine. This approach is typically employed for the rendering of 2-D graphics. For 3-D graphics, the entire screen is typically regenerated for each frame.

Pre-recorded frames stored on the gaming machine may be displayed using video "streaming". In video streaming, a sequence of pre-recorded frames stored on the gaming machine is streamed through frame buffer on the video controller 237 to one or more of the displays. For instance, a frame corresponding to a movie stored on the game partition 228 of the hard drive 222, on a CD-ROM or some other storage device may streamed to the displays 34 and 42 as part of game presentation. Thus, the game presentation may include frames graphically rendered in real-time using the graphics libraries stored on the gaming machine as well as pre-rendered frames stored on the gaming machine 2.

When the gaming machine is in a remote operational mode and a game is presented a display 126 on the mobile wireless game player 125, in one embodiment, video frame data to present a game of chance may be directly streamed from gaming machine 2 via the wireless interface 248 and wireless access point 250 to the wireless game player 125 via wireless interface 260. The video frame data may be stored in a memory 258 on the wireless game player 258 and then displayed on the display 125. The video frames sent to the wireless game player may be reduced in resolution and compressed to reduce the communication band-with necessary to transmit the video frames to the wireless game player 125.

In another embodiment of the present invention, the video frames to present a game of chance may be rendered locally on the wireless game player 125. Graphical programs that allow a game to be rendered on the wireless game player may be stored in memory 258. For instance, the memory 258 may store a graphical program to render a slot game or a graphical program to render a card game. The memory 258 may store graphical programs for one or more games. For instance, the memory 258 may store graphical routines for a plurality of games supported by gaming machine 2. In one embodiment, the wireless game player 125 may be configured to allow different graphical programs for presenting different games to be downloaded into memory 258.

In other embodiments, the wireless gaming device may include a detachable memory and interface for the detachable memory. The detachable memory may store graphical applications for one or more games. Thus, to enable a particular game, a detachable memory storing graphical applications for the particular game may inserted in the detachable memory interface on the wireless game player 125. The detachable memory may be in the form of read-only cartridges and may include a locking mechanism that prevents removal of the cartridge by the player. Thus, only authorized gaming personnel may be able to change a cartridge in the wireless game player.

The wireless game player may include a video card (not shown) to aid in the rendering process. The video card may include one or more graphical processing units that are used to render images to the display 126. The video card may be used to render 2-D graphics and 3-D graphics on the wireless game player 125. Graphical processing may also be performed by microprocessor 254 including 2-D and 3-D graphical rendering. Some images may be pre-rendered and stored on the wireless game player 125 and activated by a small string of commands from the gaming machine 2. Animations, such as reel rotation for a slot game, may be performed by routines on the wireless game player 125.

When the game graphics are rendered locally on the wireless game player 125, all of the game logic necessary to present the game of chance still resides on the gaming machine 2. Any switch or touch input necessary for game play on the wireless game player 125 (e.g., making a wager, initiating a game, holding cards, drawing cards, etc.) is transmitted 2 from the wireless game player 125 to the gaming machine 2. The gaming machine 2 executes gaming logic associated with the switch or touch inputs and sends the result back to the wireless game player 125. The wireless game player 125 verifies information sent from the gaming machine. In general, communication between the gaming machine 2 and the wireless game player 125 is encrypted. For any screen image or input involving the outcome of the game or betting, an additional level of transmit and receive data verification may be used by the wireless game player 125 and the gaming machine 2 to ensure the correct information is displayed on the wireless game player 125.

For illustrative purposes only, a series of commands between the gaming machine 2 and the wireless game player is described. The present invention is not limited to the commands described in this example. In response to input from player inputs 256 located on the wireless game player 125, the master gaming controller 224 may send a series of instructions to the wireless game player 125 that allow the game of chance to be rendered on display 126 of the wireless game player 125. The master gaming controller may also send instructions controlling audio output and other gaming devices on the wireless game player 125. For instance, for a slot game, the master gaming controller 224 may calculate symbol position, reel position, start and stop rotation for a number of reels. Then, the master gaming controller 225 may send one or more messages via the wireless communication link 252 to the wireless game player 125 with instructions such as 1) "render reels spinning", 2) "render reel 1 at position A", 3) "render reel 2 at position B", 4) "render reel 3 at position C", 5) "output audio B", 6) "display light pattern A," etc. The instructions may be processed and implemented by the microprocessor 254 using graphical software stored on the wireless game player 125.

In one embodiment of the present invention, the wireless game player may be connected to a number of peripheral devices such as a printer 270 or a card reader 272. The printer 270 and the card reader 272 may communication with the wireless game player via a wire communication protocol such as serial, parallel, USB, Firewire or IEEE 1394. The peripheral devices, such as 270 and 272, may be controlled by the microprocessor 254 according to inputs received by the wireless game player and may also be controlled by the master gaming controller 224 on the gaming machine 2.

For gaming machines, an important function is the ability to store and re-display historical game play information. The game history provided by the game history information assists in settling disputes concerning the results of game play. A dispute may occur, for instance, when a player believes an award for a game outcome was not properly credited to him by the gaming machine. The dispute may arise for a number of reasons including a malfunction of the gaming machine, a power outage causing the gaming machine to reinitialize itself and a misinterpretation of the game outcome by the player. In the case of a dispute, an attendant typically arrives at the gaming machine and places the gaming machine in a game history mode. In the game history mode, important game history information about the game in dispute can be retrieved from a non-volatile storage on the gaming machine and displayed in some manner to a display on the gaming machine. The game history information is used to reconcile the dispute.

During the game presentation, the master gaming controller 224 may select and capture certain frames to provide a game history. These decisions are made in accordance with particular game code executed by controller 224. The captured frames may be incorporated into game history frames. Typically, one or more frames critical to the game presentation are captured. For instance, in a video slot game presentation, a game presentation frame displaying the final position of the reels is captured. In a video blackjack game, a frame corresponding to the initial cards of the player and dealer, frames corresponding to intermediate hands of the player and dealer and a frame corresponding to the final hands of the player and the dealer may be selected and captured as specified by the master gaming controller. Details of frame capture for game history applications are provided co-pending U.S. application Ser. No. 09/689,498, filed on Oct. 11, 2000 by LeMay, et al., entitled, "Frame Buffer Capture of Actual Game Play," which is incorporated herein in its entirety and for all purposes.

In general, the gaming machine 2 maintains transaction logs of all events and game play. In some embodiments, as described above, the gaming machine may generate and store video frames as a game history record. The video frames may correspond to gaming information displayed on the wireless game player 125. During a wireless game play session, when the wireless game player 125 stops responding to the gaming machine 2, the game presented on the wireless game player 125 stops. The wireless game player 125 may stop responding to the gaming machine 2 because the wireless game player 125 is out-of-area reception, a battery level is low on the wireless game player, a power failure on the gaming machine 2 and other factors. To continue an interrupted game, the wireless game player 125 may ping the gaming machine 2 to reestablish communications and start the verification and authentication cycle as previously described. In the case of a dispute, the player may have to return to the gaming machine 2 so that game history records on the gaming machine can be accessed.

Figure 4:
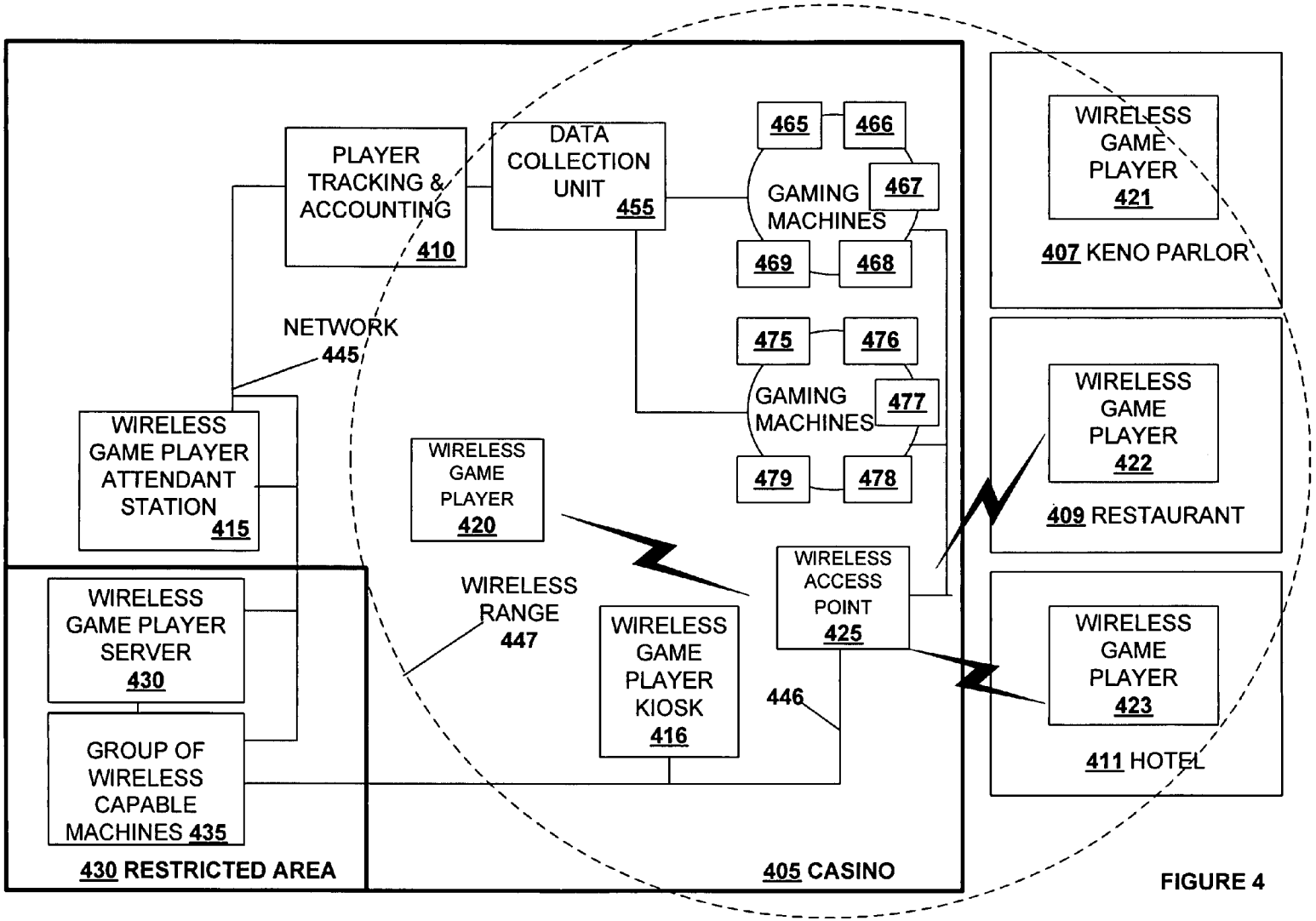
FIG. 4 is a block diagram of a network of gaming machines and wireless game players.

FIG. 4 is a block diagram of a network of gaming machines and wireless game players. Gaming machines 465, 466, 467, 468, 469, 475, 476, 477, 478 and 479, located in a floor area of casino 405, support wireless game play and are connected to a wireless access point 425. The gaming machines 465, 466, 467, 468, 469, 475, 476, 477, 478 and 479 are also connected to a player tracking system 410 via a data collection unit 455. Thus, game play on a wireless game player, such as 420, in communication with one of the gaming machines on the casino floor may generate player tracking points. Further, a player using a game player, such as 420, may be able to utilize services traditionally offered through player tracking devices on gaming machines such as a drink request. To provide the player tracking services, a player tracking service interface may be displayed on the touch screen of the wireless game player. Details of player tracking services and other gaming services that may be provided through a wireless game player of the present invention are described in co-pending U.S. application Ser. No. 09/921,489 filed on Aug. 3, 2001, by Hedrick, et al, and entitled "PLAYER TRACKING COMMUNICATION MECHANISMS IN A GAMING MACHINE" which is incorporated herein in its entirety and for all purposes.

The gaming machines located on the casino floor may also be connected to other remote servers such as but not limited to cashless system servers, progressive game servers, bonus game servers, prize servers, Internet an entertainment content server, a concierge service server and a money transfer server and the like. Game services offered by the remote servers connected to the gaming machines may also be offered on wireless game players such as 420. For instance, a game player may participate in a progressive game using the wireless game player 420. In another example, a game player may be able to perform a cashless transaction enabled by a cashless system, such as the EZPAY™ cashless system (IGT, Reno Nev.), using a wireless game player.

In one embodiment, the gaming machines 465, 466, 467, 468, 469, 475, 476, 477, 478 and 479 connected to the access point 425 are each provided with a wireless game player, such as 420, 421, 422 and 423. The gaming machines use a common wireless access point 425. In this case, the access point device is also a multi-port switch. So, each machine has an Ethernet connection to the access point 425.

In another embodiment of the present invention, an antenna may be built into a candle located on top of a gaming machine or some other location in the gaming machine. The antenna may be used as a wireless access point for wireless game play on one or more gaming machines. As an example, an antenna may be installed in the candle of gaming machine 467 to be used as a wireless access point for wireless game play on gaming machines 465, 466, 467, 468 and 469. A single gaming machine with an antenna may be used as part of a larger network of gaming devices providing wireless game play or may be used independently of a larger network.

To obtain a wireless game player on one of the gaming machines on the casino floor, a player may request a wireless game player via a service call on the gaming machine such as through the player tracking system. The request may go to a remote location, such as a terminal at a wireless game player attendant station 415 and an attendant may then bring a wireless game player to the gaming machine where the request for wireless game play has been made. The request may be routed to the attendant station 415 via the wireless game player server 430. When a wireless game player server 430 is not used, the request may be sent directly to the attendant station 415. As another example, when a request for wireless game play is made, a light on the gaming machine such as the candle on top of the gaming machine may be activated. In this case, a passing attendant may bring the game player a wireless game player. In yet another embodiment, a player may make a request for a wireless game player on a terminal at a wireless game player kiosk 416.

Prior to enabling the network connection for the wireless game play, a person or a system program may determine the customer is eligible to use the wireless game player and verify their eligibility. For instance, most gaming jurisdictions include age eligibility rules which must be obeyed. As another example, eligibility to use a wireless game player may be based upon a player's value to a casino such as a status in a player tracking club. When authentication is required, the information is loaded from the system (could be a smart-card reader on the gaming machine) or a message appears on the gaming machine instructing the customer to provide information. For example, the gaming machines could have a fingerprint sensor located on the front panel or another biometric device. When required, the gaming machine could instruct the customer that it needs a fingerprint image or other biometric information before the customer may use the wireless game player. Information obtained through biometric sensors located on the gaming machine may be compared with information contained in a customer's biometric file. In some embodiments, the biometric information file may be downloaded to the gaming machine from a remote server and the biometric comparison may be performed on the gaming machine, the gaming machine may send biometric information to a remote server where the biometric comparison is performed, or combinations thereof.

In some instances, gaming machines supporting wireless game players may be located in a high-roller area (e.g., very valued customers) and the machines may have a specially designed stand where the wireless game players are stored. The wireless game players may be enabled by an attendant or may automatically be enabled when the casino customer inserts their player-tracking card into the gaming machine (special customer). As with the gaming machines located on the casino floor, the player-tracking system or some other remote gaming device may download the customer's biometric file to the gaming machine or the gaming machines could have a fingerprint sensor located on the front panel. When required, the gaming machine may instruct the customer that it needs a fingerprint image before the customer use the wireless game player.

To establish remote operations on the wireless game player, the gaming machine may ping the wireless game player with a series of communications. In one embodiment, once this operation is completed, the game play is transferred to the wireless game player. The screen of the gaming machines may go black (perhaps with a out-of-service message) and all customer cash and switch controls are locked out (nobody can use them). The master gaming controller on the gaming machine will continue to play the games, perform all the outcome determination and cash transaction (bets & credits), and maintains all the meter information. However, all the front panel and display data is channeled to the wireless game player. In one embodiment, when the gaming machines credit balance reaches zero, the customer is required to return to the gaming machine and insert more money. To enter more money, first, the local gaming machine controls are activated by the player or an attendant. In jurisdictions where the customer can use a debit or smart card to add money to a gaming machine, a card reader (smart card) connected to the wireless game player may be used to perform this function.

In general, during a wireless game play session, the gaming machine communicates continuously with the wireless game player. In one embodiment, a web browser is used to display input switch commands. The displayed information on the wireless game player may come over from the gaming machine as HTML page information. Therefore, the wireless game player may use web-based transactions.

Additional details of a wireless game play network are described in the following paragraphs. The wireless game play network is shown in FIG. 4 is only one example of many possible embodiments of the present invention. The gaming machines and other gaming devices supporting wireless game play on wireless game players comprise a wireless game play network. The wireless game play network may be a part of a larger system network. The larger system network may provide the capability for a large number of gaming machines throughout a casino to be on the same wireless game play network. High-gain antennas and repeaters may be used to expand the range of the wireless game players allowing them to work in all areas of a casino/hotel complex, including hotels rooms and pool area. Racetracks, large bingo parlors and special outdoor events may also be covered within the wireless game play network allowing wireless game play in these areas.

The wireless game play network may also include wired access points that allow a wireless game player to be plugged directly into the network. For example, a wireless game player may include an Ethernet connector that may be directly plugged into the network segment 446. The direct network connectors may be provided with cradles used to charge the wireless game player. The charging cradles may be located at many locations within the wireless game play network.

In FIG. 4, the range of the wireless access point 425 is denoted by a circle 447 used in the wireless game play network. Many such access points may be used in a wireless game play network depending upon the network topography. For instance, due the size of a particular casino and the area covered by a single access point, there could be other access points used as repeaters located throughout the casino and hotel. In addition, the wireless access point could also be connected to an existing network. After receiving an active wireless game player, a player may use the wireless game player in the areas of casino 405 within the circle 447. Further, the player may use the wireless game player, if approved by a local gaming jurisdiction, in the areas of a keno parlor 407, a restaurant 409, and a hotel 411, which are within the circle 447. While using the wireless game player, a player may wander to different locations within circle 447 such as from the casino 405 to the restaurant 409.

In general, wireless game play in the wireless game play network is enabled by gaming devices executing licensed and regulated gaming software. However, the gaming devices supporting wireless game play are not limited gaming machines, such as 465, 466, 467, 468, 469, 475, 476, 477, 478 and 479 located on a casino floor. Special wireless-only gaming machines 435 mounted in racks or containers connected to a wireless gaming network may be used to support wireless game play using wireless game players. The wireless-only gaming machines 435 may not offer local game play. For instance, the wireless-only gaming machines 435 may not include display screens. However, the wireless-only gaming machines are still regulated and licensed in a manner similar to traditional gaming machines. As another example, a wireless game player server 430 with multiple processors may be used to support simultaneous game play on a plurality of wireless game players. The wireless-only gaming machines 435 and the wireless game play server 430 may be located in a restricted area 430 of the casino 405 and may not be generally accessible to game players.

The wireless-only gaming machines 435 and wireless game play server 430 are connected the wireless access point 425 via a connection 446. The wireless-only gaming machines 435 and wireless game play server are also in communication with a wireless game player attendant station 415 and the player tracking and accounting server 410 via network connection 445. The wireless-only gaming machine and wireless game player server 430 may also be connected to other remote gaming devices such as a progressive servers, cashless system servers, bonus servers, prize servers and the like.

When using a wireless-only gaming machine, the customer may use a kiosk, such as 416 or a cashier to enter cash and provide authentication information for a wireless game play session using a wireless game player. Then, the customer may be assigned a wireless game player, such as 420, 421, 422 and 423, in communication with one of the wireless-only gaming machines 435 or the wireless game play server 430. Once authenticated and verified, the customer may select a game and begin playing the wireless game player. There may be wireless game play cradles in the keno parlor 422, restaurant 409 or Racebook areas, allowing the customer to play their favorite casino machine game and at the same time make keno or Racebook bets or eat. In addition, the wireless game play cradles may be used to charge batteries on the wireless game player and may also be used to provide an additional network access point such as through a wire connection provided on the cradle. The wireless game player may also be used for Racebook and Keno betting. Thus, a player may watch a horserace or see the results of a certain event on the display of the wireless game player.

Finally, the wireless game player may also be used for other activities besides gaming. For example, because of the authentication and verification (security) features, the wireless game player could be safe way to conduct monetary transactions such as electronic funds transfers. As another example, the wireless game player may be used for video teleconferencing to visually connect to a casino host or to provide instant messaging services. In addition, when the wireless game player supports web-based browsers and the wireless game play network includes Internet access, the wireless game player may be used to obtain any web-based services available over the Internet.

Figure 5:
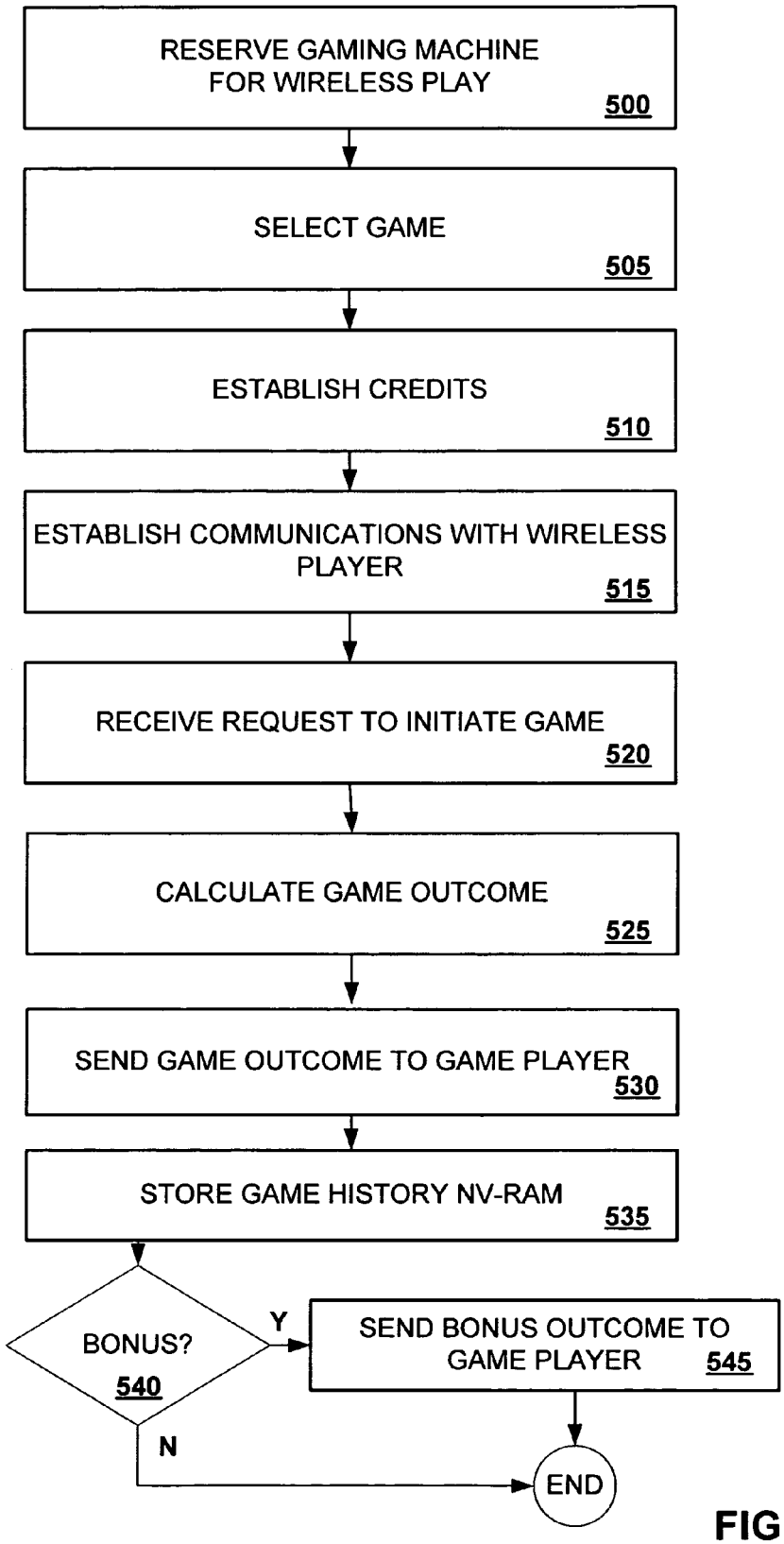
FIG. 5 is a flow chart depicting a method in a gaming machine of providing a game of chance on a wireless game player in communication with the gaming machine.

FIG. 5 is a flow chart depicting a method in a gaming machine of providing a game of chance on a wireless game player in communication with the gaming machine. In 500, a gaming machine is reserved for wireless game play. In the case of a wireless game server, the gaming machine may refer to a set of processes and memory locations executed on the wireless game server that are dedicated to providing wireless game services to a particular wireless game player. For a wireless game play server supporting wireless game play on multiple wireless game players, processes associated with a particular wireless game player may be tracked by the wireless game player server. In 505, a game available on the gaming machine is selected. In some embodiments, a portable memory cartridge may be inserted into the wireless game player to provide the selected game or programs may be loaded into the wireless game player to provide the selected game. For gaming machines offering only a single game, this step is not required. In 510, credits are established on the gaming machine.

In 515, communications are established with the wireless game player and the game play is transferred to the wireless game player to initiate a wireless game play session. Optionally, an authentication and verification process is implemented prior to transferring game play to the wireless game player. In 520, the gaming machine receives a request to initiate a game from the wireless game player. The request may be a message including information such as a wager amount for the game. The request may be in encrypted message which is decrypted by the gaming machine. Further, the gaming machine may perform various checks, such as a CRC and check sums, to validate the accuracy of any information contained in the message. In 525, the gaming machine calculates a game outcome. In 530, the gaming machine generates an encrypted message and sends the game outcome and instructions for displaying the game outcome to the wireless game player. In some embodiments, the gaming machine may receive one or messages from the wireless game player including information regarding game decisions (e.g., initiate game, wager amount, draw cards, hold cards, etc.) made by a game player using the wireless game player. The game decisions may be generated using input switches and buttons located on the wireless game player. The game decisions may affect the game outcome calculated by the gaming machine.

In 535, the gaming machine may store a record of the game to a non-volatile memory on the gaming machine. The gaming machine may also send metering information regarding the game to a player tracking and accounting server. In 540, the gaming machine determines whether a bonus game has been enabled. In 545, when a bonus game is enabled, the gaming machine may send a bonus outcome and instructions for displaying a bonus outcome to the wireless game player.

The gaming machine may terminate a wireless game play session as a result of a number of events. For example, the gaming machine may track the location of the wireless game player using a GPS device located in the game player. When the wireless game player enters an area not authorized for wireless game play, the gaming machine may terminate the wireless game play session. As another example, the gaming machine may terminate a wireless game play session after a certain of games, after a certain amount of time or after a period of inactivaty.

Figure 6:
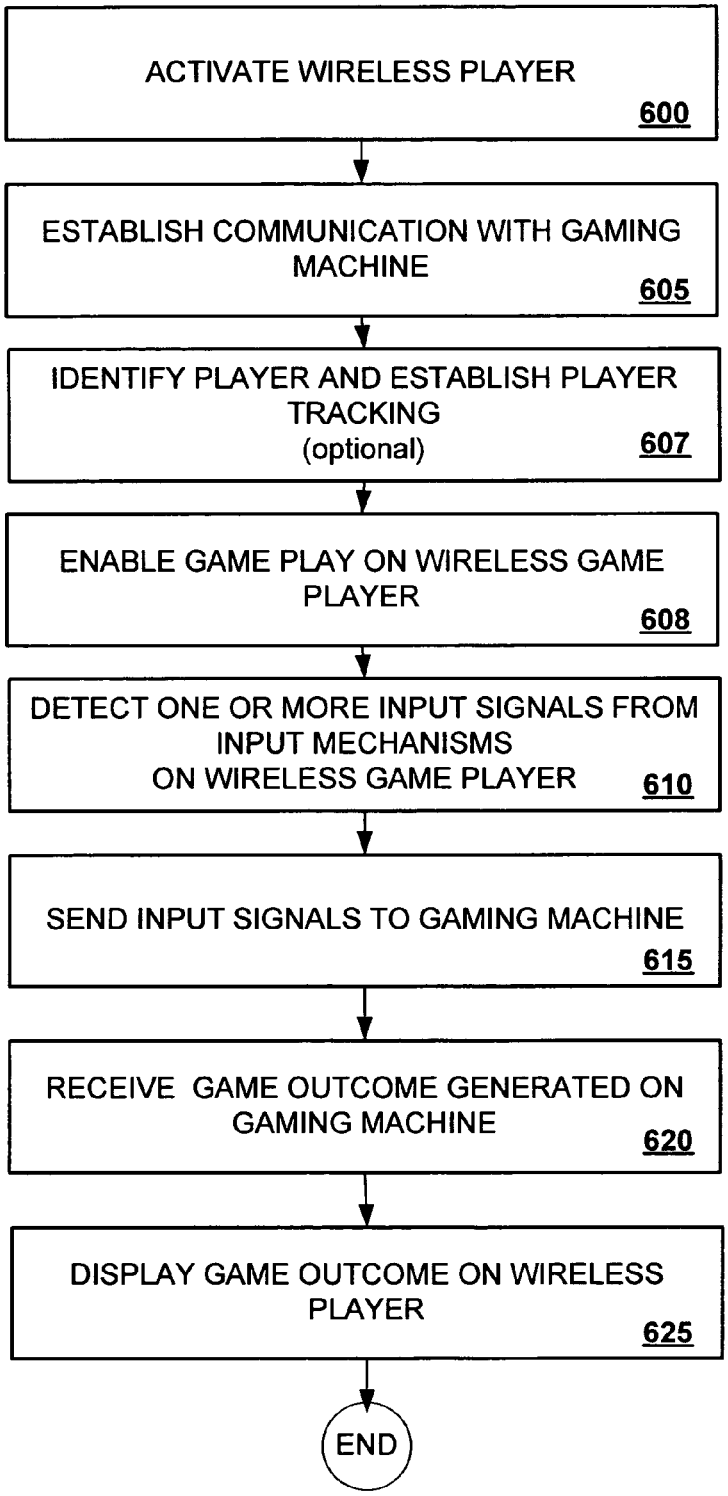
FIG. 6 is a flow chart depicting a method of providing a game of chance in a wireless game player in communication with a gaming machine

FIG. 6 is a flow chart depicting a method of providing a game of chance in a wireless game player in communication with a gaming machine. As described above, the wireless game player in many embodiments of the present invention is a remote extension of the gaming machine where game play outcomes, such as RNG (random number generation) events, are generated on the gaming machine. However, a properly licensed and regulated wireless game player may also provide direct game play without the use of a remote gaming machine i.e. all gaming functions are performed on the wireless game player.

In 600, the wireless game player is activated. The activation process may include turning on the power to the wireless game player and any self-checks, such as boot procedures, performed by the wireless game player. In 605, communications are established with the gaming machine. In 607, an authentication and verification process is optionally implemented using the wireless game player. For instance, the wireless game player may include a biometric input device such as a finger print reader.

In 608, game play on the wireless game player is enabled. In some embodiments, wireless game play may not be enabled until certain security procedures have been followed such verifying a serial number associated with the wireless game player, verifying the identity of a game player and combinations thereof. On some wireless game players and gaming machines, multiple games may be supported. Thus, while using the wireless game player, a player may have the option of selecting a new game. In 610, one or more input signals are detected from input mechanisms on the wireless game player such as mechanical buttons or from a touch screen. The input signals may be used to make a wager, initiate a game or make game decisions. In 615, the input signals are sent in one or messages to the gaming machine. In general, the messages are encrypted. In 620, one or messages containing a game outcome generated on the gaming machine and instructions for displaying the game outcome may be received by the wireless game player. The one or more message are decrypted by the wireless game player. Further, the wireless game player may perform various checks, such as a CRC and check sums, to validate the accuracy of any information contained in the messages from the gaming machine. In 625, the game outcome is displayed on the wireless game player. Additionally, a bonus game outcome may also be displayed.

Although the foregoing invention has been described in some detail for purposes of clarity of understanding, it will be apparent that certain changes and modifications may be practiced within the scope of the appended claims. For instance, while one of the gaming machines of this invention have been depicted as having top box mounted on top of the main gaming machine cabinet, the use of gaming devices in accordance with this invention is not so limited. For example, gaming machine may be provided without a top box.

What is claimed is:

1. A gaming system comprising:

a gaming machine including: a housing defining a gaming machine interior, a first master gaming controller disposed within the gaming machine interior, a first memory, a first display, a first communication interface for communicating with at least one other device in a gaming network, and a first user input interface for receiving input from a first player;

the gaming machine being operable to:

1) control at least one wager-based game played at the gaming machine;

2) operate in a first mode of operation corresponding to a local game play mode of operation;

3) enable, while in the first mode of operation, the first player to engage in local game play activities conducted locally at the first gaming machine, at least a portion of the local game play activities being implemented using the first master gaming controller, at least a portion of the local game play activities being conducted via use of the first user input interface and the first display;

4) operate in a second mode of operation corresponding to a remote game play mode of operation;

5) enable, while in the second mode of operation, a second player, the second player being different from the first player, to engage in a portion of remote game play activities conducted remotely at a first wireless gaming device in communication with the gaming machine, at least a portion of the remote game play activities being implemented using the first master gaming controller, at least a portion of the remote game play activities being conducted via use of a remote user input interface and a second display located at the first wireless gaming device;

6) display content relating to the local game play activities at the first display;

7) display content relating to the remote game play activities at the second display;

8) receive local game play instructions relating to the local game play activities via the first user input interface;

9) receive remote game play instructions relating to the remote game play activities via the second user input interface;

10) receive a first input signal from the first user input interface to initiate a first game play session for enabling the first player to play a first game locally at the gaming machine;

11) receive a second input signal from the first wireless gaming device to initiate a second game play session for enabling the second player to play a second game remotely at the first wireless gaming device, the first game being independent of the second game, an outcome of the first game being dependent upon a first random number and an outcome of the second game being dependent upon a second random number; and 12) enable the first player to play the first game locally and the second player to play the second game remotely concurrently.

2. The gaming system of claim 1, the gaming machine being further operable to:

enable a third player to engage in second remote game play activities conducted remotely from the gaming machine via a second wireless gaming device in communication with the gaming machine; and enable the second player and the third player to each concurrently engage in remote game play activities conducted remotely from the gaming machine, at least a portion of the first and second remote game play activities being implemented using the first master gaming controller.

3. The gaming system of claim 1, the gaming machine being further operable to:

enable a third player to engage in second remote game play activities conducted remotely from the gaming machine via a second wireless gaming device in communication with the gaming machine;

receive a third input signal from the second wireless gaming device to initiate a third game play session for enabling the third player to play a third game remotely at the second wireless gaming device.

4. The gaming system of claim 1, the gaming machine being further operable to:

prevent the first player from engaging in local game play activities conducted locally at the gaming machine during at least a portion of time when the gaming machine is operating in the second mode of operation.

5. The gaming system of claim 1, the gaming machine being further operable to:

prevent the second player from engaging in remote game play activities conducted remotely from the gaming machine during at least a portion of time when the gaming machine is operating in the first mode of operation.

6. The gaming system of claim 1, the gaming machine being further operable to:

establish a first communication link with the first wireless gaming device; and allow the remote game play activities to be conducted at the first wireless gaming device only during times while the first communication link is active.

7. The gaming system of claim 1, the gaming machine being further operable to:

establish a first communication link with the first wireless gaming device; and allow the remote game play activities to be conducted at the first wireless gaming device only during times while the first communication link is active, the first communication link being implemented using at least one network device other than the gaming machine and the first wireless gaming device.

8. The gaming system of claim 1, the gaming machine being further operable to:

establish a first communication link with the first wireless gaming device;

implement, at the gaming machine, a first plurality of operations for conducting the remote game play activities at the first wireless gaming device only during times while the first communication link is active;

the first plurality of operations includes:

generating a game outcome for a game of chance using regulated gaming software executed by the first master gaming controller;

presenting remotely the game outcome for the game of chance on the first wireless gaming device, the first wireless gaming device being operable to display a graphical rendition of the outcome of the game of chance comprising a sequence of video frames and sound associated with the graphical rendition;

receiving information from input signals generated from one or more input mechanisms located at the first wireless gaming device, said input signals being at least for making wagers on the game outcome for the game of chance for playing the game of chance; and maintaining and updating credit information for the first wireless gaming device resulting from playing the game of chance as each game of chance is played remotely.

9. The gaming system of claim 1, the gaming machine being further operable to present a bonus game at the first wireless gaming device.

10. The gaming system of claim 1, the gaming machine being further operable to:

receive information for a selection of a type of game of chance for play on the first wireless gaming device; and generate the game outcome for the type of game of chance that is selected.

11. The gaming system of claim 1, the gaming machine being further operable to:

store a game history record of the game of chance played on the first wireless gaming device.

12. The gaming system of claim 1, the gaming machine being further operable to:

determine an identity of the second player using biometric information input via at least one biometric input device located at the first wireless gaming device.

13. The gaming system of claim 1, the gaming machine being further operable to:

establish a first communication link with the first wireless gaming device;

implement, at the gaming machine, a first plurality of operations for conducting the remote game play activities at the first wireless gaming device during times while the first communication link is active;

generate a game outcome for a game of chance using regulated gaming software executed by the first master gaming controller;

present remotely the game outcome for the game of chance on the first wireless gaming device, the first wireless gaming device being operable to display a graphical rendition of the outcome of the game of chance comprising a sequence of video frames and sound associated with the graphical rendition;

receive information from input signals generated from one or more input mechanisms located at the first wireless gaming device, said input signals being at least for making wagers on the game outcome for the game of chance for playing the game of chance; and maintain and update credit information for the first wireless gaming device resulting from playing the game of chance as each game of chance is played remotely; and terminate the play of the game of chance on the first wireless gaming device during times when the first communication link between the first wireless gaming device and the gaming machine is determined to be inactive.

14. The gaming system of claim 1, the gaming machine further comprising an input mechanism for receiving cash or an indicia of credit.

15. The gaming system of claim 1, the first master gaming controller being operable to establish simultaneously active communication links with a plurality of wireless gaming devices.

16. The gaming system of claim 1, the gaming machine being further operable to:

establish simultaneously a first active communication link with the first wireless gaming device and a second active communication link with a second wireless gaming device;

generate a first game outcome for a first type of game of chance played at the first wireless gaming device; and generate a second game outcome for a second type of game of chance played at the second wireless gaming device.

17. The gaming system of claim 1, the at least one wager-based game including at least one game selected from a group consisting of: slot games, poker games, pachinko games, multiple hand poker games, pai-gow poker games, black jack games, keno games, bingo games, roulette games, crap games and card games.

18. The gaming system of claim 1, the gaming machine being further operable to:

provide a shared game that is played simultaneously on a plurality of remote wireless gaming devices, at least a portion of game play operations relating to the shared game being implemented using first master gaming controller.

19. The gaming system of claim 18, the shared game being a bingo game or a keno game.

20. A method of operating a gaming system to provide remote and local game play capabilities, the gaming system including a gaming machine having: a housing defining a gaming machine interior, a first master gaming controller disposed within the gaming machine interior, a first memory, a first display, a first communication interface for communicating with at least one other device in a gaming network, and a first user input interface for receiving input from a first player; the method comprising:

1) controlling at least one wager-based game played at the gaming machine;

2) operating the gaming machine in a first mode of operation corresponding to a local game play mode of operation;

3) enabling, while in the first mode of operation, the first player to engage in local game play activities conducted locally at the first gaming machine, wherein at least a portion of the local game play activities are implemented using the first master gaming controller, wherein at least a portion of the local game play activities are conducted via use of the first user input interface and the first display;

4) operating the gaming machine in a second mode of operation corresponding to a remote game play mode of operation;

5) enabling, while in the second mode of operation, a second player, wherein the second player is different from the first player, to engage in a portion of remote game play activities conducted remotely at a first wireless gaming device in communication with the gaming machine; wherein at least a portion of the remote game play activities are implemented using the first master gaming controller; wherein at least a portion of the remote game play activities are conducted via use of a remote user input interface and a second display located at the first wireless gaming device;

6) displaying content relating to the local game play activities at the first display;

7) displaying content relating to the remote game play activities at the second display;

8) receiving local game play instructions relating to the local game play activities via the first user input interface;

9) receiving remote game play instructions relating to the remote game play activities via the second user input interface;

10) receiving a first input signal from the first user input interface to initiate a first game play session for enabling the first player to play a first game locally at the gaming machine; and 11) receiving a second input signal from the first wireless gaming device to initiate a second game play session for enabling the second player to play a second game remotely at the first wireless gaming device, wherein initiation of the first game play session is independent of initiation of the second game play session.

21. The method of claim 20 further comprising:

enabling a third player to engage in second remote game play activities conducted remotely from the gaming machine via a second wireless gaming device in communication with the gaming machine; and receiving a third input signal from the second wireless gaming device to initiate a third game play session for enabling the third player to play a third game remotely at the second wireless gaming device.

22. The method of claim 20 further comprising:

receiving a third input signal from the second wireless gaming device to initiate a third game play session for enabling the third player to play a third game remotely at the second wireless gaming device.

23. The method of claim 20 further comprising:

enabling a third player to engage in second remote game play activities conducted remotely from the gaming machine via a second wireless gaming device in communication with the gaming machine; and enabling the second player and the third player to each concurrently engage in remote game play activities conducted remotely from the gaming machine, at least a portion of the first and second remote game play activities being implemented using the first master gaming controller.

24. The method of claim 20 further comprising:

preventing the first player from engaging in local game play activities conducted locally at the gaming machine during at least a portion of time when the gaming machine is operating in the second mode of operation.

25. The method of claim 20 further comprising:

preventing the second player from engaging in remote game play activities conducted remotely from the gaming machine during at least a portion of time when the gaming machine is operating in the first mode of operation.

26. The method of claim 20 further comprising operating the gaming machine to:

establish a first communication link with the first wireless gaming device; and allow the remote game play activities to be conducted at the first wireless gaming device only during times while the first communication link is active.

27. The method of claim 20 further comprising operating the gaming machine to:

establish a first communication link with the first wireless gaming device; and allow the remote game play activities to be conducted at the first wireless gaming device only during times while the first communication link is active, the first communication link being implemented using at least one network device other than the gaming machine and the first wireless gaming device.

28. The method of claim 20 further comprising operating the gaming machine to:

establish a first communication link with the first wireless gaming device;

implement, at the gaming machine, a first plurality of operations for conducting the remote game play activities at the first wireless gaming device only during times while the first communication link is active;

generate a game outcome for a game of chance using regulated gaming software executed by the first master gaming controller;

present remotely the game outcome for the game of chance on the first wireless gaming device, the first wireless gaming device being operable to display a graphical rendition of the outcome of the game of chance comprising a sequence of video frames and sound associated with the graphical rendition;

receive information from input signals generated from one or more input mechanisms located at the first wireless gaming device, said input signals being at least for making wagers on the game outcome for the game of chance for playing the game of chance; and maintain and update credit information for the first wireless gaming device resulting from playing the game of chance as each game of chance is played remotely.

29. The method of claim 20, further comprising operating the gaming machine to:

present a bonus game at the first wireless gaming device.

30. The method of claim 20, further comprising operating the gaming machine to:

receive information for a selection of a type of game of chance for play on the first wireless gaming device; and generate the game outcome for the type of game of chance that is selected.

31. The method of claim 20, further comprising operating the gaming machine to:

store a game history record of the game of chance played on the first wireless gaming device.

32. The method of claim 20, further comprising operating the gaming machine to:

determine an identity of the second player using biometric information input via at least one biometric input device located at the first wireless gaming device.

33. The method of claim 20 further comprising operating the gaming machine to:

establish a first communication link with the first wireless gaming device;

implement, at the gaming machine, a first plurality of operations for conducting the remote game play activities at the first wireless gaming device during times while the first communication link is active;

generate a game outcome for a game of chance using regulated gaming software executed by the first master gaming controller;

present the game outcome for the game of chance on the first wireless gaming device, the first wireless gaming device being operable to display a graphical rendition of the outcome of the game of chance comprising a sequence of video frames and sound associated with the graphical rendition;

receive information from input signals generated from one or more input mechanisms located at the first wireless gaming device, said input signals being at least for making wagers on the game outcome for the game of chance for playing the game of chance; and maintain and update credit information for the first wireless gaming device resulting from playing the game of chance as each game of chance is played remotely; and terminate the play of the game of chance on the first wireless gaming device during times when the first communication link between the first wireless gaming device and the gaming machine is determined to be inactive.

34. The method of claim 20, further comprising:

operating the gaming machine to establish simultaneously active communication links with a plurality of wireless gaming devices.

35. The method of claim 20, further comprising operating the gaming machine to:

establish simultaneously a first active communication link with the first wireless gaming device and a second active communication link with a second wireless gaming device; and generate a first game outcome for a first type of game of chance played at the first wireless gaming device; and generate a second game outcome for a second type of game of chance played at the second wireless gaming device.

36. The method of claim 20, further comprising operating the gaming machine to:

provide a shared game that is played simultaneously on a plurality of remote wireless gaming devices, at least a portion of game play operations relating to the shared game being implemented using first master gaming controller.

37. A gaming system comprising:

a gaming machine including: a housing defining a gaming machine interior, a first master gaming controller disposed within the gaming machine interior, a first memory, a first display, a first communication interface for communicating with at least one other device in a gaming network, and a first user input interface for receiving input from a first player;

1) means for controlling at least one wager-based game played at the gaming machine;

2) means for operating the gaming machine in a first mode of operation corresponding to a local game play mode of operation;

3) means for enabling, while in the first mode of operation, the first player to engage in local game play activities conducted locally at the first gaming machine, at least a portion of the local game play activities being implemented using the first master gaming controller, at least a portion of the local game play activities being conducted via use of the first user input interface and the first display;

4) means for operating the gaming machine in a second mode of operation corresponding to a remote game play mode of operation;

5) means for enabling, while in the second mode of operation, a second player, the second player being different from the first player, to engage in a portion of remote game play activities conducted remotely at a first wireless gaming device in communication with the gaming machine, at least a portion of the remote game play activities being implemented using the first master gaming controller, at least a portion of the remote game play activities being conducted via use of a remote user input interface and a second display located at the first wireless gaming device;

6) means for displaying content relating to the local game play activities at the first display;

7) means for displaying content relating to the remote game play activities at the second display;

8) means for receiving local game play instructions relating to the local game play activities via the first user input interface; and 9) means for receiving remote game play instructions relating to the remote game play activities via the second user input interface, 10) means for receiving a first input signal from the first user input interface to initiate a first game play session for enabling the first player to play a first game locally at the gaming machine;

11) means for receiving a second input signal from the first wireless gaming device to initiate a second game play session for enabling the second player to play a second game remotely at the first wireless gaming device, the first game being independent of the second game, an outcome of the first game being dependent upon a first random number and an outcome of the second game being dependent upon a second random number; and 12) means for enabling the first player to play the first game locally and the second player to play the second game remotely concurrently.

* * * * *

UNITED STATES PATENT AND TRADEMARK OFFICE

CERTIFICATE OF CORRECTION

PATENT NO. : 7,850,528 B2
APPLICATION NO. : 11/014150
DATED : December 14, 2010
INVENTOR(S) : William R. Wells It is certified that error appears in the above-identified patent and that said Letters Patent is hereby corrected as shown below:

In line 9 of claim 8 (column 27, line 40) change "includes" to --including--.
In line 17 of claim 20 (column 29, line 22) remove "wherein".
In line 18 of claim 20 (column 29, line 23) change "are" to --being--.
In line 19 of claim 20 (column 29, line 24) remove "wherein".
In line 20 of claim 20 (column 29, line 25) change "are" to --being--.
In line 27 of claim 20 (column 29, line 32) remove "wherein".
In line 27 of claim 20 (column 29, line 32) change "is" to --being--.
In line 31 of claim 20 (column 29, line 36) change "machine; wherein" to --machine,--.
In line 32 of claim 20 (column 29, line 37) change "are" to --being--.
In line 33 of claim 20 (column 29, line 38) change "controller; wherein" to --controller,--.
In line 34 of claim 20 (column 29, line 39) change "are" to --being--.
In line 50 of claim 20 (column 29, line 55) remove "and".
In line 54 of claim 20 (column 29, line 59) change "wherein initiation of the first game play session is independent of initiation of the second game play session." to --the first game being independent of the second game, an outcome of the first game being dependent upon a first random number and an outcome of the second game being dependent upon a second random number; and 12) enabling the first player to play the first game locally and the second player to play the second game remotely concurrently.--.

Signed and Sealed this
Twenty-fifth Day of January, 2011

David J. Kappos

David J. Kappos
*Director of the United States Patent and Trademark Office*